US012274910B2

(12) United States Patent
Scovill

(10) Patent No.: US 12,274,910 B2
(45) Date of Patent: Apr. 15, 2025

(54) EXERCISE SYSTEMS AND METHODS

(71) Applicant: Jay Patterson Scovill, Gainesville, GA (US)

(72) Inventor: Jay Patterson Scovill, Gainesville, GA (US)

( * ) Notice: Subject to any disclaimer, the term of this patent is extended or adjusted under 35 U.S.C. 154(b) by 0 days.

(21) Appl. No.: 18/695,709

(22) PCT Filed: Sep. 27, 2022

(86) PCT No.: PCT/US2022/044914
§ 371 (c)(1),
(2) Date: Mar. 26, 2024

(87) PCT Pub. No.: WO2023/049517
PCT Pub. Date: Mar. 30, 2023

(65) Prior Publication Data

US 2024/0424339 A1 Dec. 26, 2024

Related U.S. Application Data

(60) Provisional application No. 63/270,848, filed on Oct. 22, 2021, provisional application No. 63/248,976, filed on Sep. 27, 2021.

(51) Int. Cl.
*A63B 22/00* (2006.01)
*A63B 21/00* (2006.01)
(Continued)

(52) U.S. Cl.
CPC ..... *A63B 22/0012* (2013.01); *A63B 21/0414* (2013.01); *A63B 21/0552* (2013.01);
(Continued)

(58) Field of Classification Search
CPC . A63B 21/04; A63B 21/0407; A63B 21/0414; A63B 21/0421; A63B 21/0428;
(Continued)

(56) References Cited

U.S. PATENT DOCUMENTS 1,585,748 A * 5/1926 Wendelken ..... A63B 21/16 482/146
3,911,907 A * 10/1975 Smith, Jr. ..... A63B 23/03533 601/5

(Continued)

FOREIGN PATENT DOCUMENTS

CN 203577232 U 5/2014

OTHER PUBLICATIONS

International Search Report and Written Opinion, dated Feb. 24, 2023, received in connection with corresponding International Patent Application No. PCT/US2022/044914, 13 pages.

*Primary Examiner* — Gary D Urbiel Goldner
(74) *Attorney, Agent, or Firm* — Meunier Carlin & Curfman LLC

(57) ABSTRACT

Various implementations of the systems and methods disclosed herein allow a user to build at least a portion of the musculature used for the front crawl stroke and/or offer a platform for practicing and learning proper form for certain exercises, such as, for example, swimming the front crawl stroke. In addition, the devices, systems, and methods disclosed herein may be useful for strengthening overall body tone and aerobic strength. Various implementations include an exercise system that includes an arm movement system and/or a torso movement system. The arm movement system may be provided and/or used independently of the torso movement system. Various implementations of the devices, systems and methods disclosed herein simulate the resistive forces of water encountered by a human body while swimming and allow the user to learn and maintain proper form while strengthening muscles used to counter-act those resistive forces, without the complications of a water environment.

22 Claims, 15 Drawing Sheets

(51) Int. Cl.

| | |
|---|---|
| ***A63B 21/04*** | (2006.01) |
| ***A63B 21/055*** | (2006.01) |
| ***A63B 21/062*** | (2006.01) |
| ***A63B 22/14*** | (2006.01) |
| ***A63B 22/20*** | (2006.01) |

(52) U.S. Cl.
CPC ..... *A63B 21/0626* (2015.10); *A63B 21/4035* (2015.10); *A63B 21/4045* (2015.10); *A63B 22/0005* (2015.10); *A63B 22/14* (2013.01); *A63B 22/203* (2013.01)

(58) Field of Classification Search
CPC ..... A63B 21/0435; A63B 21/0442; A63B 21/055; A63B 21/0552; A63B 21/0555; A63B 21/0557; A63B 21/062; A63B 21/0624; A63B 21/0626; A63B 21/0628; A63B 21/15; A63B 21/151; A63B 21/154; A63B 21/4035; A63B 21/4045; A63B 21/4049; A63B 22/0005; A63B 22/001; A63B 22/0012; A63B 22/14; A63B 22/18; A63B 22/203; A63B 69/10; A63B 2244/20
See application file for complete search history.

(56) References Cited

U.S. PATENT DOCUMENTS 4,305,579 A * 12/1981 Rice ..... A63B 23/0216 482/147
4,386,915 A * 6/1983 Gilliam ..... A63B 69/18 482/146
4,515,363 A * 5/1985 Schleffendorf .. A63B 23/03533 482/136
4,538,807 A * 9/1985 Rice ..... A63B 22/14 482/133
4,673,180 A * 6/1987 Rice ..... A63B 22/14 482/110
4,844,450 A 7/1989 Rodgers, Jr.
4,948,119 A * 8/1990 Robertson, Jr. .... A63B 21/4013 482/130
5,366,426 A * 11/1994 Glavin ..... A63B 21/4031 482/142
5,526,541 A * 6/1996 Massey ..... A61G 7/1098 5/81.1 RP
5,586,962 A * 12/1996 Hallmark ..... A63B 21/4007 482/129
5,941,807 A * 8/1999 Cassidy ..... A63B 21/4009 482/130
7,081,074 B1 * 7/2006 Rubin ..... A63B 22/14 482/146
8,647,239 B1 2/2014 Sokolovas et al.
8,678,985 B2 * 3/2014 Mattox ..... A63B 21/0004 482/148
9,737,751 B2 * 8/2017 Anderson ..... A63B 21/16
10,486,009 B2 * 11/2019 Huppée ..... A63B 21/00065
10,532,239 B1 * 1/2020 Suarez Monne ..... A63B 17/04
10,737,139 B2 * 8/2020 Walker ..... A63B 21/4049
10,765,911 B1 * 9/2020 Hamoy ..... A63B 23/0205
11,154,751 B2 * 10/2021 Bosch ..... A63B 23/0216
11,331,536 B1 * 5/2022 Wood ..... A61B 5/1124
11,547,891 B2 * 1/2023 Powell ..... A63B 24/0087
12,076,610 B2 * 9/2024 Bosch ..... A63B 21/4049
2003/0036467 A1 * 2/2003 Almada ..... A63B 41/125 482/148
2006/0276311 A1 * 12/2006 Martin ..... A63B 21/0552 482/92
2010/0130336 A1 * 5/2010 McSorley ..... A63B 21/0552 482/110
2010/0173759 A1 * 7/2010 Lalaoua ..... A63B 21/4005 482/121
2010/0267526 A1 * 10/2010 Baschnagel ..... A63B 21/4043 482/148
2012/0202656 A1 * 8/2012 Dorsay ..... A63B 21/156 482/121
2014/0315171 A1 * 10/2014 Tsai ..... A63B 69/10 434/254
2016/0236025 A1 * 8/2016 Henan ..... A63B 23/0355
2018/0361200 A1 * 12/2018 Walker ..... A63B 21/00069
2021/0260438 A1 * 8/2021 Bosch ..... A63B 21/154
2022/0233914 A1 * 7/2022 Birger ..... A63B 24/0062

* cited by examiner

EXERCISE SYSTEMS AND METHODS

CROSS-REFERENCE TO RELATED APPLICATIONS

This application claims the benefit of U.S. Provisional Patent Application No. 63/270,848, filed Oct. 22, 2021, and U.S. Provisional Patent Application No. 63/248,976, filed Sep. 27, 2021, the contents of which are incorporated herein by reference in their entirety.

BACKGROUND

Many people have difficulty learning to swim, particularly the freestyle or front crawl stroke, and many people who have learned how to swim this stroke have not learned how to swim it with efficiency. Traditionally, swimming is taught in the water and not in a controlled environment outside of the water. Many people are reluctant to learn how to swim due to a fear of drowning. Many people also hesitate to begin swimming as it can be considered too difficult and requires specific motor skills not easily developed. There is a need for a type of "dry land" training/workout device (e.g., a low or no impact aerobic exercise device with a comprehensive upper and/or lower body workout that promotes good health). Further, some individuals are not able to swim due to health conditions that can make swimming in water too dangerous or unfeasible. Current non-aquatic swimming trainer devices require a user to be in a horizontal position. These devices are not widely adopted because they are uncomfortable after a short session (e.g., 10 minutes). Current swimming devices isolate arm and shoulder movement from torso and leg movement. They do not simulate the motion or dynamic resistance experienced while swimming.

Thus, there is a need in the art for improved exercise systems and methods.

SUMMARY

Various implementations include an exercise system. The system includes an arm movement system and a torso movement system. The arm movement system includes a first handle guide, a second handle guide, a first handle, and a second handle. The first handle guide includes a central axis that extends between a first end and a second end of the first handle guide. The second handle guide is adjacent to the first handle guide. The second handle guide includes a central axis that extends between a first end and a second end of the first handle guide. The central axes of the first handle guide and the second handle guide are parallel in a resting position. The first handle is movably coupled to the first handle guide. The second handle is movably coupled to the second handle guide. The torso movement system includes a rotatable platform having a rotational axis. The rotatable platform is rotatable about the rotational axis thereof. The central axis of each handle guide is parallel to the rotational axis of the rotatable platform, and the rotatable platform is disposed adjacent the handle guides such that a user having the user's body supported by the rotatable platform can reach the handles with the user's hands.

In some implementations, each handle guide includes first and second handle guide cords and first and second handle guide springs. In some implementations, the first handle guide spring is coupled to one end of the first handle guide cord, and the second handle guide spring is coupled to one end of the second handle guide cord. In some implementations, the handle guide springs create a reaction force in response to movement of the respective handle along the handle guide cords in a direction that has a perpendicular component relative to the central axis of the respective handle guide. In some implementations, each handle guide includes third and fourth handle guide springs. In some implementations, the third handle guide spring is coupled to the other end of the first handle guide cord, and the fourth handle guide spring is coupled to the other end of the second handle guide cord. In some implementations, each of the handle guide springs includes an elastic band.

In some implementations, the system further includes a first handle spring coupled to the first handle and a second handle spring coupled to the second handle. In some implementations, the first handle spring creates a reaction force in response to movement of the first handle in a direction that has a parallel component relative to the central axis of the first handle guide and the second handle spring creates a reaction force in response to movement of the second handle in a direction that has a parallel component relative to the central axis of the second handle guide. In some implementations, the system further includes a first handle weight coupled to the first handle and a second handle weight coupled to the second handle. In some implementations, the system further includes first and second handle damping springs. In some implementations, the first handle damping spring is coupled to and disposed between the first handle weight and the first handle, and the second handle damping spring is coupled to and disposed between the second handle weight and the second handle. In some implementations, each of the handle damping springs includes an elastic band.

In some implementations, the central axes of the handle guides are disposed in a plane that is at an angle from 80° to 100° relative to a support surface on which the system is configured to be disposed.

In some implementations, the first handle guide and the second handle guide are axially bendable.

In some implementations, the system further includes a torso weight coupled to the rotatable platform. In some implementations, the torso weight coupled to the rotatable platform provides a resistive force against rotational movement of the rotatable platform about the rotational axis from a start position to an angular position spaced apart from the start position. In some implementations, the torso weight is coupled to the rotatable platform by a linkage that extends between the torso weight and the rotatable platform. In some implementations, the linkage includes an axially bendable cord. In some implementations, the axially bendable cord includes first and second axially bendable cords. In some implementations, a first end of the first axially bendable cord is coupled to a first portion of the rotatable platform, a first end of the second axially bendable cord is coupled to a second portion of the rotatable platform, and second ends of the axially bendable cords are coupled to the torso weight. In some implementations, the first portion and the second portion of the rotatable platform are separated by a plane that includes the rotational axis.

In some implementations, the system further includes a ring bearing coupling a first surface of the rotatable platform to a stationary platform. In some implementations, the first surface faces the stationary platform, and a second surface of the rotatable platform is opposite the first surface and faces away from the stationary platform.

In some implementations, the system further includes a torso damping spring coupled to and disposed between the torso weight and the rotatable platform.

In some implementations, the system further includes a track having an arcuate shaped portion. In some implementations, the torso weight is movably coupled to the arcuate shaped portion of the track. In some implementations, the track has a first end and a second end, and the arcuate shaped portion is disposed between the first and second ends. In some implementations, a center of the arcuate shaped portion is disposed in a plane that is closer than the ends of the track to a support surface on which the system is configured for being disposed.

In some implementations, the rotational axis of the rotatable platform extends perpendicular to a support surface on which the system is configured for being disposed.

In some implementations, the system further includes a chair coupled to the rotatable platform.

In some implementations, the system further includes a kicking mechanism coupled to the rotatable platform. The mechanism includes a first pedestal guide, a second pedestal guide, a first pedestal, a second pedestal, a first pedestal spring, and a second pedestal spring. Each pedestal guide includes a track having a first end and a second end. The first pedestal is movably coupled to the first pedestal guide, and the second pedestal is movably coupled to the second pedestal guide. The first pedestal spring is coupled to the first pedestal that creates a reaction force in response to movement of the first pedestal in a first direction along the respective track. The second pedestal spring is coupled to the second pedestal that creates a reaction force in response to movement of the second pedestal in the first direction along the respective track.

In some implementations, the kicking mechanism further includes a third pedestal spring coupled to the first pedestal that creates a reaction force in response to movement of the first pedestal in a second direction along the respective track, and a fourth pedestal spring coupled to the second pedestal that creates a reaction force in response to movement of the second pedestal in the second direction along the respective track. In some implementations, the first direction is opposite the second direction.

In some implementations, the system further includes a kicking mechanism coupled to the rotatable platform. The mechanism includes a first skate guide, a second skate guide, a first skate, and a second skate. Each skate guide includes a skate track having a first end and a second end. The first skate is movably coupled to the first skate guide, and the second skate is movably coupled to the second skate guide. Each of the first and second skates includes a body and one or more skate wheels rotatably coupled to the body. The first skate guide extends along a first arcuate path having a lowest point between the first end and second end of the first skate guide. The second skate guide extends along a second arcuate path having a lowest point between the first end and second end of the second skate guide.

Various other implementations include an exercise system. The system includes a first handle guide, a second handle guide, a first handle, and a second handle. The first handle guide includes a central axis that extends between a first end and a second end of the first handle guide. The second handle guide includes a central axis that extends between a first end and a second end of the second handle guide. The central axis of the second handle guide is adjacent to the central axis of the first handle guide, and the central axes of the first and second handle guides are parallel to each other in a resting position. The first handle is movably coupled to the first handle guide. The second handle is movably coupled to the second handle guide. Each handle guide includes first and second handle guide cords and first and second handle guide springs. The first handle guide spring is coupled to an end of the first handle guide cord, and the second handle guide spring is coupled to an end of the second handle guide cord. The handle guide springs are configured to create a reaction force in response to movement of the respective handle in a direction that has a perpendicular component relative to the central axis of the respective handle guide. The handle spring is coupled to each handle. The handle spring is configured to create a reaction force in response to movement of the respective handle in a direction that has a parallel component relative to the central axis of the respective handle guide.

In some implementations, each handle guide further includes third and fourth handle guide springs. In some implementations, the third handle guide spring is coupled to the other end of the first handle guide cord, and the fourth handle guide spring is coupled to the other end of the second handle guide cord.

In some implementations, each of the handle guide springs and the handle springs includes an elastic band.

In some implementations, the system further includes a first handle weight coupled to the first handle and a second handle weight coupled to the second handle. In some implementations, he system further includes first and second handle damping springs. The first handle damping spring is coupled to and disposed between the first handle weight and the first handle, and the second handle damping spring is coupled to and disposed between the second handle weight and the second handle. In some implementations, each of the handle damping springs includes an elastic band.

In some implementations, the first handle guide and the second handle guide are axially bendable.

In some implementations, the central axes of the handle guides are disposed in a plane that is at an angle from 80° to 100° relative to a support surface on which the system is configured to be disposed.

In some implementations, the system further includes a kicking mechanism. The kicking mechanism includes a first pedestal guide, a second pedestal guide, a first pedestal, a second pedestal, a first pedestal spring, and a second pedestal spring. Each pedestal guide includes a track having a first end and a second end. The first pedestal is movably coupled to the first pedestal guide, and the second pedestal is movably coupled to the second pedestal guide. The first pedestal spring is coupled to the first pedestal that creates a reaction force in response to movement of the first pedestal in a first direction along the respective track. The second pedestal spring is coupled to the second pedestal that creates a reaction force in response to movement of the second pedestal in the first direction along the respective track. The pedestal guides are disposed in a plane that is transverse to the plane that includes the central axes of the handle guides.

In some implementations, the plane that includes the pedestal guides is perpendicular to the plane that includes the central axes of the handle guides. In some implementations, the kicking mechanism further includes a third pedestal spring coupled to the first pedestal that creates a reaction force in response to movement of the first pedestal in a second direction along the respective track, and a fourth pedestal spring coupled to the second pedestal that creates a reaction force in response to movement of the second pedestal in the second direction along the respective track. In some implementations, the first direction is opposite the second direction.

In some implementations, the system further includes a kicking mechanism coupled to the rotatable platform. The mechanism includes a first skate guide, a second skate guide, a first skate, and a second skate. Each skate guide includes a skate track having a first end and a second end. The first skate is movably coupled to the first skate guide, and the second skate is movably coupled to the second skate guide. Each of the first and second skates includes a body and one or more skate wheels rotatably coupled to the body. The first skate guide extends along a first arcuate path having a lowest point between the first end and second end of the first skate guide. The second skate guide extends along a second arcuate path having a lowest point between the first end and second end of the second skate guide.

Various other implementations include an exercise system. The system includes a rotatable platform and a torso weight. The rotatable platform has a rotational axis extending through the platform. The torso weight is coupled to the rotatable platform. The torso weight provides a resistive force against rotational movement of the rotatable platform about the rotational axis from a start position to an angular position spaced apart from the start position.

In some implementations, the torso weight is coupled to the rotatable platform by a linkage that extends between the torso weight and the rotatable platform. In some implementations, the linkage includes an axially bendable cord. In some implementations, the axially bendable cord includes first and second axially bendable cords. In some implementations, a first end of the first axially bendable cord is coupled to a first portion of the rotatable platform, a first end of the second axially bendable cord is coupled to a second portion of the rotatable platform, and second ends of the axially bendable cords are coupled to the torso weight. In some implementations, the first portion and the second portion of the rotatable platform are separated by a plane that includes the rotational axis.

In some implementations, the system further includes a ring bearing coupling a first surface of the rotatable platform to a stationary platform. In some implementations, the first surface faces the stationary platform, and a second surface of the rotatable platform is opposite the first surface and faces away from the stationary platform.

In some implementations, the system further includes a track having an arcuate shaped portion. In some implementations, the torso weight is movably coupled to the arcuate shaped portion of the track. In some implementations, the track has a first end and a second end, and the arcuate shaped portion is disposed between the first and second ends. In some implementations, a center of the arcuate shaped portion is disposed in a plane that is configured to be closer to a support surface on which the system is disposed than the ends of the track.

In some implementations, a torso damping spring is coupled to and disposed between the torso weight and the rotatable platform.

In some implementations, the rotational axis of the rotatable platform extends perpendicular to a support surface upon which the system is configured to be disposed.

In some implementations, the system further includes a chair coupled to the rotatable platform.

In some implementations, the system further includes a kicking mechanism coupled to the rotatable platform. The kicking mechanism includes a first pedestal guide, a second pedestal guide, a first pedestal, a second pedestal, a first pedestal spring, and a second pedestal spring. Each pedestal guide includes a track having a first end and a second end. The first pedestal is movably coupled to the first pedestal guide, and the second pedestal is movably coupled to the second pedestal guide. The first pedestal spring is coupled to the first pedestal that creates a reaction force in response to movement of the first pedestal in a first direction along the respective track. The second pedestal spring is coupled to the second pedestal that creates a reaction force in response to movement of the second pedestal in the first direction along the respective track.

In some implementations, the kicking mechanism further includes a third pedestal spring coupled to the first pedestal that creates a reaction force in response to movement of the first pedestal in a second direction along the respective track, and a fourth pedestal spring coupled to the second pedestal that creates a reaction force in response to movement of the second pedestal in the second direction along the respective track. In some implementations, the first direction is opposite the second direction.

In some implementations, the system further includes a kicking mechanism coupled to the rotatable platform. The mechanism includes a first skate guide, a second skate guide, a first skate, and a second skate. Each skate guide includes a skate track having a first end and a second end. The first skate is movably coupled to the first skate guide, and the second skate is movably coupled to the second skate guide, wherein each of the first and second skates includes a body and one or more skate wheels rotatably coupled to the body. The first skate guide extends along a first arcuate path having a lowest point between the first end and second end of the first skate guide. The second skate guide extends along a second arcuate path having a lowest point between the first end and second end of the second skate guide.

BRIEF DESCRIPTION OF THE DRAWINGS

Example features and implementations are disclosed in the accompanying drawings. However, the present disclosure is not limited to the precise arrangements and instrumentalities shown.

DETAILED DESCRIPTION

Figure 1:
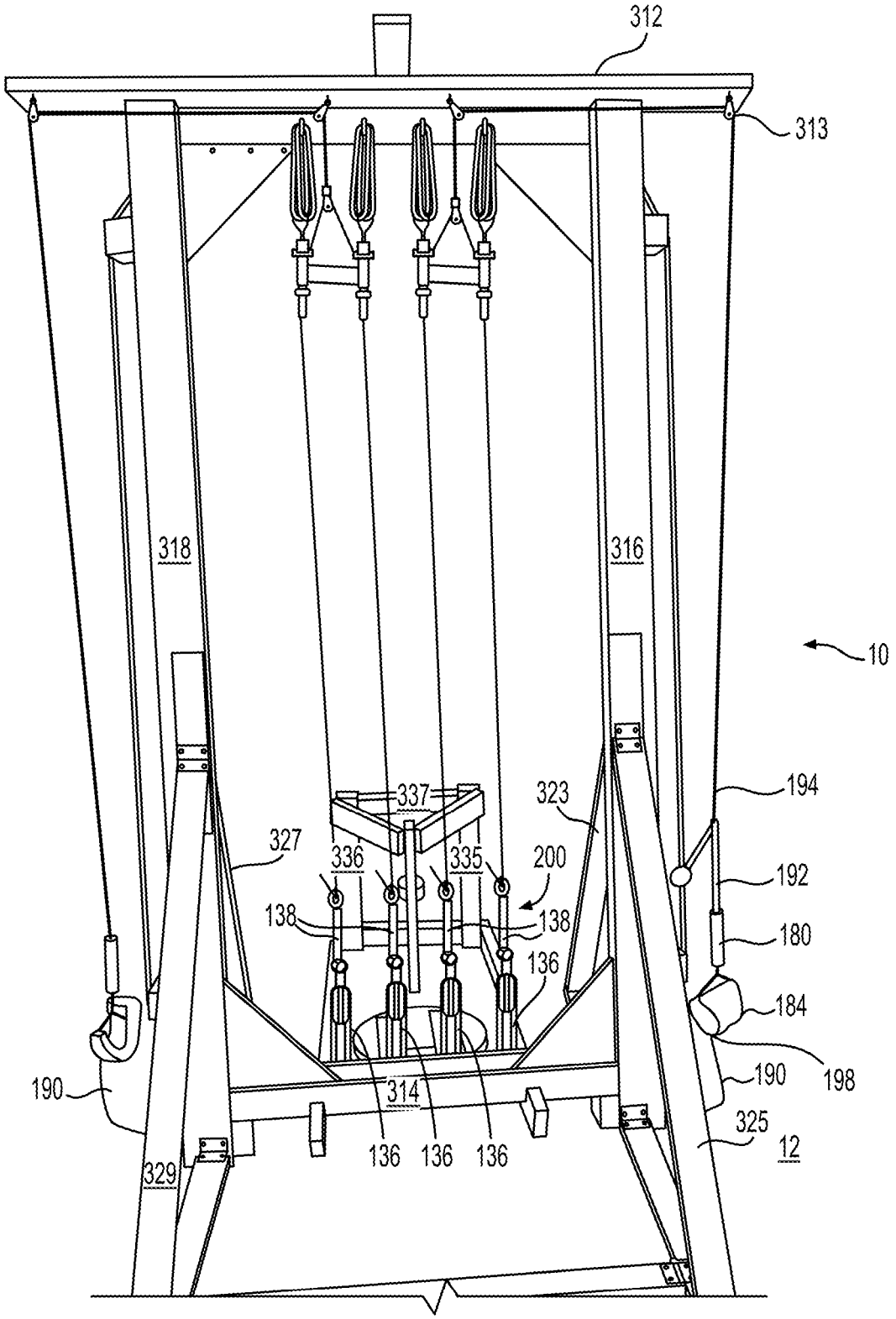
FIG. 1 is a perspective front view of an exercise system according to one implementation.

The devices, systems, and methods disclosed herein allow a user to build at least a portion of (e.g., all) the musculature used for the freestyle or front crawl stroke, according to various implementations. It also offers a platform for practicing and learning proper form for certain exercises. For example, the devices, systems, and methods disclosed herein may be useful for training muscles and/or practicing form used in swimming the freestyle or front crawl stroke. In addition, the devices, systems, and methods disclosed herein may be useful for strengthening overall body tone and aerobic strength.

Various implementations include an exercise system that includes an arm movement system and/or a torso movement system. The arm movement system may be provided and/or used independently of the torso movement system. In some implementations, a kicking mechanism may be provided and/or used independently of the torso movement system and/or the arm movement system.

Various implementations of the devices, systems and methods disclosed herein simulate (e.g., duplicate) the resistive forces of water encountered by a human body while swimming and allows the user to learn and maintain proper form while strengthening muscles used to counter-act those resistive forces, without the complications of a water environment. Because water is 816 times denser than air, the resistive forces encountered by the arm and hand of a swimmer are very complex to duplicate.

According to various implementations, the arm movement system includes a first handle guide, a second handle guide, a first handle, and a second handle. Each handle guide has a central axis that extends between a first end and a second end of the respective handle guide. The first handle is movably coupled to the first handle guide, and the second handle is movably coupled to the second handle guide. In some implementations, the handle guides are adjacent to each other, And, in some implementations, the central axes of the handle guides are parallel to each other when in a resting position (e.g., no force on the handles by the user).

According to various implementations, the torso movement system includes a rotatable platform having a rotational axis, wherein the rotatable platform is rotatable about the rotational axis. According to some implementation, the central axis of each handle guide is parallel to the rotational axis of the rotatable platform when the handle guides are in the resting position, and the rotatable platform is disposed adjacent the handle guides such that a user having the user's body supported by the rotatable platform can reach the handles with the user's hands.

In some implementations, the central axes of the handle guides are disposed in a first vertical plane that is at an angle from 80° to 100° (e.g., 90°) relative to a support surface on which the system is configured to be disposed when in the resting position. In some implementations, the central axes of the handle guides are oriented within the first vertical plane at an angle from 60° to 120° relative to the support surface (e.g., 90° relative to the support surface) when in the resting position.

In further or additional implementations, the handle guides are axially bendable.

In further or additional implementations, each handle guide comprises first and second handle guide cords and a handle guide spring coupled to an end of each handle guide cord. The handle guide spring creates a reaction force in response to movement of the first handle in a direction with a perpendicular component relative to the central axis of the respective handle guide cord. In some implementations, a handle guide spring may be coupled to each end of each handle guide cord.

In further or additional implementations, a handle spring is coupled to each handle. The handle spring coupled to each handle creates a reaction force in response to movement of the respective handle in a direction that has a parallel component relative to the central axis of the respective handle guide when in the resting position.

In some implementations, the handle guide springs and the handle springs are elastic "workout" or "resistance" bands.

In further or additional implementations, a handle weight is coupled to one or both handles. The handle weight has a known mass and exerts linear resistance against a lifting force on the handle weight. The handle weight can be, for example, disc weights, barbells, weight bags, or sandbags. And, in a further or additional implementation, a damping spring is coupled to and disposed between each handle weight and the respective handle to which the handle weight is coupled. As the handle is moved downwardly, the handle weight is urged upwardly, and the damping spring slows the acceleration of the handle weight by absorbing energy from the downward movement of the handle, which creates a smoother transition in the amount of resistance to moving the handle perceived by the user. And, when the handle reaches the bottom or top of its path along the handle guides, the damping spring absorbs the vibrational energy of the handle weight from its movement upwardly or downwardly.

In further or additional implementations, a handle damping spring is coupled to and disposed between each handle weight and the respective handle. In some implementations, the handle damping springs are elastic "workout" or "resistance" bands.

In further or additional implementations, a torso weight is coupled to the rotatable platform and provides a resistive force against rotational movement of the rotatable platform about the rotational axis from a start position to an angular position spaced apart from the start position. For example, in some implementations, the torso weight is coupled to the rotatable platform by a linkage that extends between the torso weight and the rotatable platform. The linkage, according to some implementations, is an axially bendable cord. For example, in some implementations, the axially bendable cord includes first and second axially bendable cords, each having first and second ends. The first end of the first axially bendable cord is coupled to a first portion of the rotatable platform, a first end of the second axially bendable cord is coupled to a second portion of the rotatable platform, and second ends of the axially bendable cords are coupled to the torso weight. The first portion and the second portion of the rotatable platform are separated by a plane that includes the rotational axis. In some implementations, a torso damping spring is coupled to and disposed between the torso weight and the rotatable platform.

In further or additional implementations, the torso movement system further includes a track having an arcuate shaped portion, and the torso weight is movably coupled to the arcuate shaped portion of the track. The track has a first end and a second end, and the arcuate shaped portion is disposed between the first and second ends. A center of the arcuate shaped portion is disposed in a plane that is closer to the support surface on which the system is disposed than the ends of the track. According to some implementations, the track allows the torso weight to maintain a portion of momentum as it moves toward the center of the arcuate shaped portion of the track from a position between the center and one of the ends of the track in response to gravity and the rotation of the rotatable platform in another direction.

In further or additional implementations, the rotational axis of the rotatable platform extends perpendicular to the support surface on which the system is disposed.

In further or additional implementations, a first surface of the rotatable platform and a stationary platform of the torso movement system are coupled together by a ring bearing, which may also be referred to as a turntable bearing or a lazy Susan bearing. The first surface of the rotatable platform faces the stationary platform, and a second surface of the rotatable platform is opposite the first surface and faces away from the stationary platform.

In further or additional implementations, the exercise system may also include a kicking mechanism that is coupled to the rotatable platform or is coupled to a stationary platform. The kicking mechanism includes first and second pedestal guides, first and second pedestals, and first and second pedestal springs. Each pedestal guide includes a track having a first end and a second end. The tracks are linearly oriented along parallel axes extending between the ends of each track, and the axes of the tracks of the kicking system lie within a plane that is parallel to the support surface on which the system is disposed, according to some implementations. The first pedestal is movably coupled to the first pedestal guide, and the second pedestal is movably coupled to the second pedestal guide. The first pedestal spring is coupled to the first pedestal and creates a reaction force in response to movement of the first pedestal in a first axial direction along the track of the first pedestal guide, and the second pedestal spring is coupled to the second pedestal and creates a reaction force in response to movement of the second pedestal in the first axial direction along the track of the second pedestal guide.

In further or additional implementations, the kicking mechanism further comprises third and fourth pedestal springs. The third pedestal spring is coupled to the first pedestal, and the fourth pedestal spring is coupled to the second pedestal. The third pedestal spring creates a reaction force in response to movement of the first pedestal in a second direction, and the fourth pedestal spring creates a reaction force in response to movement of the second pedestal in the second direction, wherein the first direction is opposite the second direction.

The resistance to the movements described herein (e.g., of moving the handles along the handle guides, rotating the rotatable platform, and/or moving the pedestals along their respective tracks) can be varied (increased or decreased) by increasing or decreasing the resistance of the springs (e.g., changing the material and/or construction to change the spring constant, changing the distance that spring can be pulled (or compressed) from its resting position) and/or increasing or decreasing the mass of the weights coupled to the handles and/or rotatable platform.

FIGS. 1-7 illustrate an exercise system 10, according to one implementation. The exercise system 10 includes a frame, an arm movement system 100, and a torso movement system 200. The frame includes a vertically oriented frame and a horizontally oriented frame. The vertically oriented frame is coupled to the horizontally oriented frame in FIGS. 1 and 7, but in other implementations, the frames may be uncoupled from each other and disposed adjacent to each other.

The vertically oriented frame comprises an upper horizontal member 312, a lower horizontal member 314, a first vertical member 316, and second vertical member 318. The members 312, 314, 316, 318 comprise a rigid material and are coupled together (e.g., by fasteners) into a rectangular arrangement. A plane that extends through the rectangular arrangement of the rigid members 312, 314, 316, 318 is perpendicular to a support surface 12 (e.g., ground, flooring) on which the system 10 is disposed. However, in other implementations, the plane may be at an angle of 80° to 100° relative to the support surface 12. The vertical members 316, 318 may be further supported in an upright position by diagonally oriented members 323, 325, 327, 329 that are coupled to the vertical members 316, 318 and extend to additional horizontal members that are disposed on the support surface 12 or to the support surface 12 (e.g., in an A-frame arrangement as shown in FIGS. 1 and 7).

Figure 7:
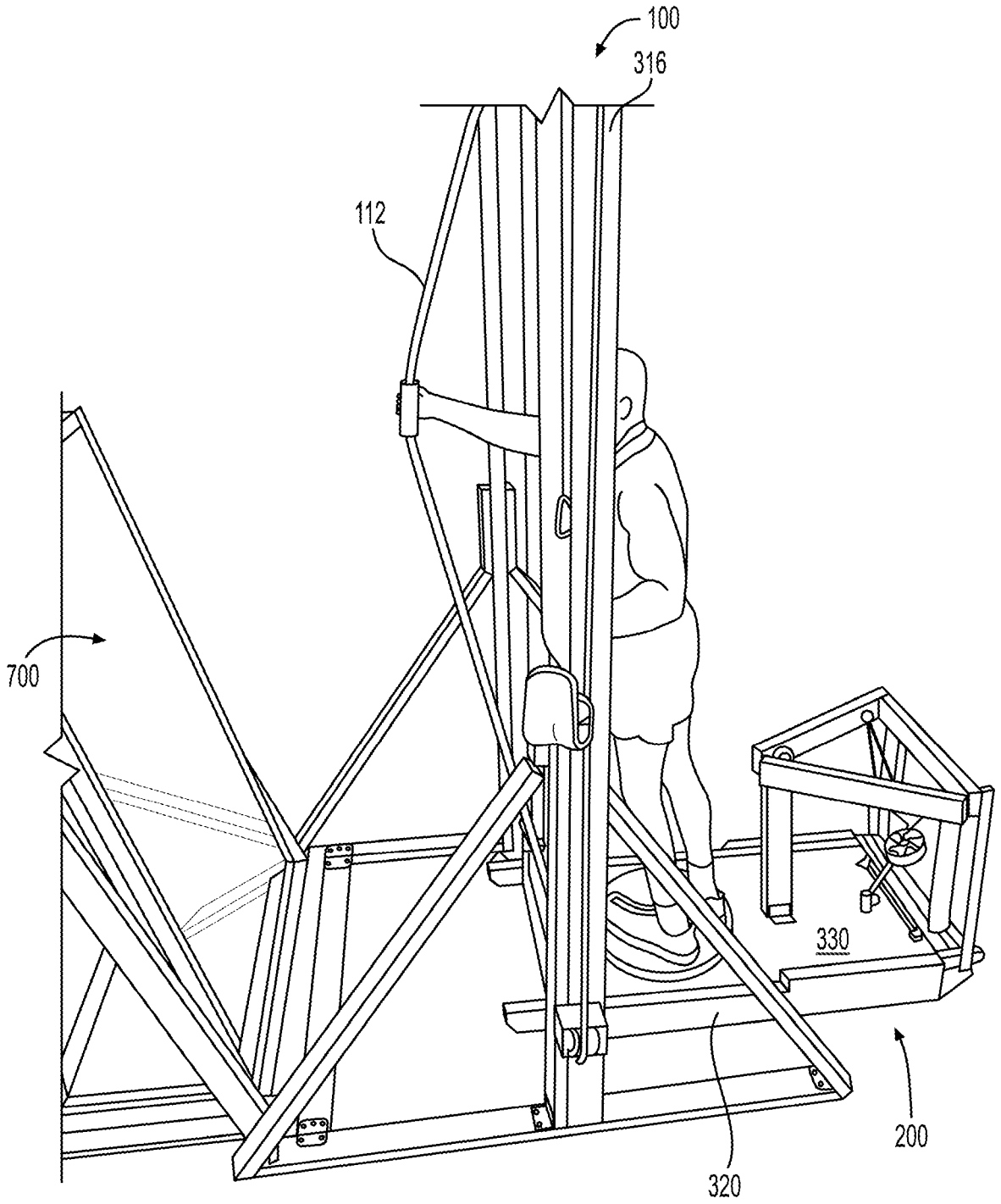
FIG. 7 is a side view of a mirror and the system shown in FIG. 1.

In the implementation shown in FIGS. 1 and 7, the rigid members 312, 314, 316, 318 are wooden 2×4s that are coupled to wooden 2×6s that are coupled together by screws and/or bolts. However, in other implementations, the members 312, 314, 316, 318 may include other rigid materials, such as metal and/or plastic, and/or other fasteners, such as nails, ties, clips, adhesive, welding, or other suitable fastener for securing the members in the rectangular or other shaped arrangement. Furthermore, in other implementations, the vertical and/or the horizontal members may be telescoping. Telescoping vertical members allow for a height of the vertically oriented frame to be reduced, and telescoping horizontal members allow for a width of the vertically oriented frame to be reduced. Telescoping members allows the user to reduce the volume the vertically oriented frame occupies when not in use and/or to adjust to the vertically oriented frame to various heights and/or widths depending on the preferences of the user of the system. In other implementations, the members of the vertically oriented frame may be coupled together to allow for the members to be collapsed into a footprint that is smaller than when in use (e.g., using hinges, telescoping members, and/or other suitable mechanisms for allowing the members to be arranged into a smaller footprint).

The arm movement system 100 is coupled to the vertically oriented frame and includes a first handle guide 110, a second handle guide 120, a first handle 150, and a second handle 160. Each handle guide 110, 120 has a first end 114, 124 and a second end 116, 126 and a central axis A, B, respectively, that extends between the respective ends 114, 116, 124, 126.

When in a resting position (e.g., no force being applied to the handles by the user), the central axes A, B of the handle guides 110, 120 are straight and oriented in a first vertical plane that is perpendicular to the support surface 12 on which the system 100 is disposed. In other implementations, the first vertical plane may be at an angle of 80° to 100° (e.g., 90°) with the support surface 12. In some implementations, the axes of the handle guides can be adjusted to be oriented within the first vertical plane at an angle from 60° to 120° relative to the support surface 12.

Each handle guide 110, 120 comprises two axially bendable cords 130, 140 that are adjacent each other, respectively, and extend generally parallel to the central axis A, B of the respective handle guide 110, 120. The handle guide cords 130, 140 are standard 7/16" non-stretch mountaineering climbing rope. However, in other implementations, the handle guide cords are any material that is axially bendable and is not stretchable.

The handle guides 110, 120 further comprise a handle guide spring 136 coupled to each end of each handle guide cord 130, 140. The handle guide springs 136 create a reaction force on each handle 150, 160 via the handle guide cords 130, 140 in response to movement of the handle 150, 160 in a direction that has a component perpendicular to the central axes A, B of the handle guide 110, 120 (e.g., inward toward the user or outward away from the user). The line tension in the handle guides 110, 120 increases the further the handle 150, 160 is moved away from the first vertical plane. The reaction force acts in a direction having a perpendicular component relative to the respective central axis A, B of the respective handle guide 110, 120. For example, the reaction force from each handle guide 110, 120 has a component in a direction toward the user's shoulder and/or through the user's core, and this reactive force toward the user's shoulder and/or core causes rotation of the rotatable platform of the torso movement system 200 when the arm movement system and torso movement system are used together, as discussed below. The resistance of the handle guide 110, 120 to being moved outside of the first vertical plane by applying force to the handle 150, 160 is adjustable depending on adjustments made to the handle guide spring(s) 136 at the ends of each handle guide cord 130, 140 (e.g., selecting a handle guide spring with a different spring constant or changing the length of the spring in the resting position).

Figure 2:
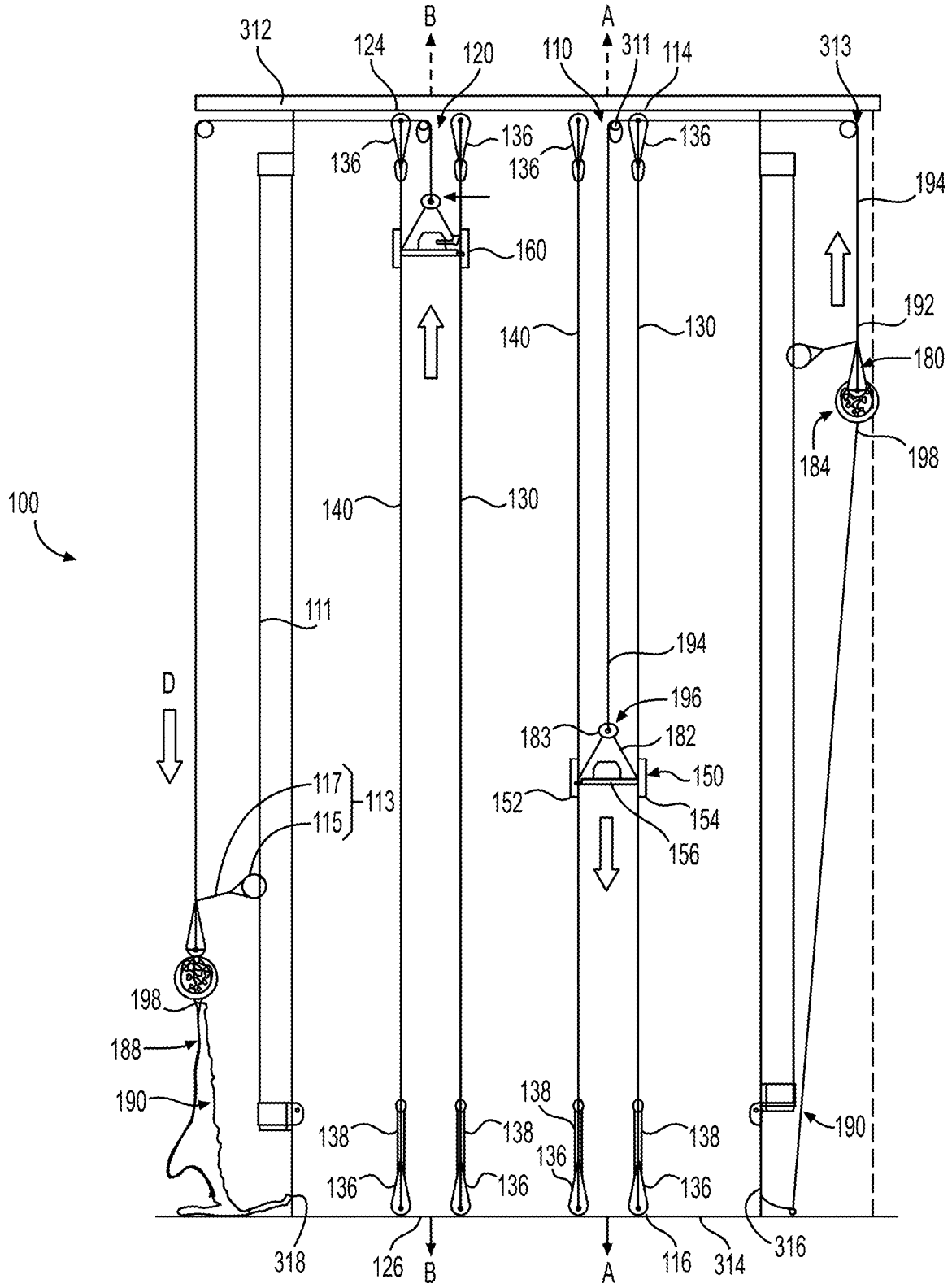
FIG. 2 is a front view of an arm movement system of the exercise system shown in FIG. 1.

The handle guide springs 136 shown in FIGS. 1 and 2 are elastic "workout" or "resistance" bands. The handle guide cords 130, 140 have knots at each end thereof that directly couple each end of each cord 130, 140 with a carabiner. Each carabiner coupled to the upper ends of the handle guide cords 130, 140 is directly coupled to the elastic band 136 that is directly coupled to upper horizontal member 312. Each carabiner coupled to the lower ends of the handle guide cords 130, 140 is coupled to an elastic band 136 that is coupled to the lower horizontal member 314. Grommeted straps 138 are coupled (e.g., directly) to the elastic bands 136 and extend between the elastic bands 136 and the lower ends of the handle guide cords 130, 140 such that each carabiner coupled to the lower ends of the handle guide cords 130, 140 engages one of the grommet openings of the respective strap 138. To increase the tension of the elastic bands 136 in the resting position, the stretch length of the elastic band 136 when the handle guides 110, 120 are in the resting position is increased by coupling the carabiner to a grommet opening that is closer to the elastic band 136, which shortens the length of the portion of the grommet strap extending between the handle guide cord and the elastic band and increases the length of the elastic band, increasing the tension of the elastic band while in the resting position. Although grommeted straps are shown in FIGS. 1 and 2 as being coupled between the lower ends of the handle guide cords 130, 140 and the lower horizontal frame member 314, in other implementation, grommeted straps may be disposed between and couple the upper ends of the handle guide cords and the upper horizontal frame member 312. And, in other implementations, other non-axially stretchable members may be used instead of the grommeted strap.

In the implementations described herein and shown in the figures, the springs are elastic "workout" or "resistance" bands, but in other implementations, the springs are coil springs or any other type of spring suitable to provide graded tension and/or dynamic load resistance in response to a force on the handle guide cords having a perpendicular component relative to the central axes of the handle guides. In other implementations, the springs can be replaced with graded hydraulic, electric, or systems that create resistive loads (e.g., hydraulic or electric pistons).

The first handle 150 is movably coupled to the first handle guide 110, and the second handle 160 is movably coupled to the second handle guide 120. In the implementation shown in FIGS. 1 and 2, the handles 150, 160 slide along the handle guide cords 130, 140. The handles 150, 160 and the handle guides 110, 120 are each positioned to provide a rotational counter force when the user pushes the handles 150, 160 out and down, mimicking the freestyle or front crawl stroke.

Each handle 150, 160 comprises a pair of vertical tubes 152, 154 and a horizontal tube 156 coupled between the vertical tubes 152, 154 in an H-shaped arrangement. The tubes 152, 154, 156 may be formed from PVC or other suitably rigid material (e.g., rigid plastic and/or metal). The handle guide cords 130, 140 extend through the vertical tubes 152, 154, respectively, and the horizontal tube 156 is disposed between the pair of handle guide cords 152, 154. The user grips the horizontal tube 156 to move the handle 150, 160 through the simulated stroke along the respective handle guide 110, 120. The inner diameter of the vertical tubes 152, 154 is greater than the diameter of the handle guide cords 130, 140 to allow the vertical tubes 152, 154 to slide relative to the handle guide cords 130, 140. However, the difference between the inner diameters of the vertical tubes 152, 154 and the diameter of the handle guide cords 130, 140 is less than or equal to 1/16 inches, which creates friction between the inner diameter of the vertical tubes 152, 154 and the respective handle guide cords 130, 140. This friction keeps the handles 150, 160 in place along the handle guides 110, 120 in the resting position until the handles 150, 160 are moved along the handle guides 110, 120 by the user. In addition, the difference between the inner diameters of the vertical tubes 152, 154 and the diameter of the handle guide cords 130, 140 being less than $1/16^{th}$ inches and the bend caused in the handle guide cords 130, 140 about the handle 150, 160 as the handle 150, 160 is pulled downwardly (as shown in FIG. 7) causes dynamic resistance to the handles 150, 160 as they are moved downwardly along the handle guides 110, 120. For example, the resistive force to moving the handles 150, 160 downwardly increases as the handles 150, 160 are moved further downwardly and outwardly from the start of the pull portion of the user's stroke (i.e., the end of the reach portion of the stroke) toward an apex of an arcuate path 112 of the handles 150, 160, and the resistive force decreases as the handles 150, 160 are moved further downwardly and inwardly from the apex of the arcuate path 112 of the handles 150, 160 to the end of the pull portion of the user's stroke (i.e., the start of the reach portion of the user's stroke). The start of the pull portion may be at a position above a horizontal plane that includes the top of the user's head, for example, and the end of the pull portion is below this position (e.g., below the horizontal plane that includes the user's shoulders). These additional frictional forces generate greater dynamic resistance to the handles 150, 160 that corresponds to the distance between the handle 150, 160 and the first vertical plane that the handle 150, 160 occupies in the resting position. In other words, as the distance between the handle 150, 160 and the first vertical plane increases, the friction between handle 150, 160 and handle guide 110, 120 increases, generating a greater dynamic resistance to movement of the handle 150, 160 along the handle guide 110, 120. In addition, the difference between the inner diameters of the vertical tubes 152, 154 and the diameter of the handle guide cords 130, 140 also allows the handles 150, 160 to be moved to the end of the reach portion of the stroke (or start of the pull portion of the stroke) with nominal resistance from the handle guide cords 130, 140, which is comparable to the airborne condition of the hand swimming freestyle as it returns through the air to begin the next pull portion of the stroke.

A handle spring 190 is coupled to each handle. The handle spring 190 coupled to each handle 150, 160 creates a reaction force in response to movement of the respective handle 150, 160 in a direction that has a parallel component relative to the central axis A, B of the respective handle guide 110, 120 when in the resting position. The handle spring 190 is an elastic band that is coupled at one end thereof to the lower horizontal frame member 314 or adjacent thereto on the adjacent vertical member 316, 318. The other end of the elastic band 190 is coupled (e.g., directly) to a second end 192 of a handle cord 194, and the first end 196 of the handle cord 194 is coupled to the handle 150, 160. The length of the handle cord 194 can be selected such that the resistance of the handle spring is acting on the handle cord during the entire downward movement of the handle or just a portion thereof. For example, in some implementations, the handle cord length may be selected such that the handle spring 190 is not providing resistance to the downward movement of the handle 150, 160 until the handle 150, 160 begins to move downward and inwardly toward the user, such as when the handle is at or near the horizontal level of the user's shoulder. The handle spring 190 counteracts the reduced resistance on the movement of the handles 150, 160 along the handle guides 110, 120 as the handle guide cords 130, 140 are bent less and approach the first vertical plane.

Furthermore, in the implementation shown, a stop cord 188 is coupled to the proximal end 198 of the handle spring 190 and the vertically oriented frame and runs alongside a stretching axis C of the handle spring 190. The length of the stop cord 188 corresponds to the maximum length that the handle spring 190 should be stretched during use, which protects the handle spring 190 from breaking or plastic deformation.

A handle connector cord 182 is directly coupled to each end of the horizontal tube 156 of the handle 150, 160, and a handle connector 183 is coupled directly to the handle connector cord 182, causing the handle connector cord 182 to form a V-shape when the handle 150, 160 is pulled in a direction with a downward component. The handle connector 183 allows the handle connector cord 182 to move along the handle connector 183, and the handle connector 183 couples (e.g., directly) the handle connector cord 182 to the handle cord 194. However, in other implementations, the handle connector may not be directly coupled to the handle cord and/or the handle connector cord, and one or more connectors may be disposed between the handle and the handle cord.

Each handle cord 194 runs along a respective first frame handle cord direction guide 311 that is coupled to the upper horizontal frame member 312 and a respective second frame handle cord direction guide 313 that is coupled to the upper horizontal frame member 312 or the adjacent vertical frame member 316, 318. The first and second frame handle cord direction guides 311, 313 change the direction of the respective handle cord 194 and allow the respective handle cord 194 to slide relative to the respective frame handle cord direction guides 311, 313 such that each respective handle cord 194 extends upwardly from the handle connector 183 (above the respective handle 150, 160) and then extends laterally over to the adjacent respective vertical frame member 316, 318 and then downwardly toward the handle spring 190.

The handle connector 183 and the frame handle cord direction guides 311, 313 shown in FIGS. 1 and 7 are single wheel pulleys. However, in other implementations, the handle connector may include a clip, a carabiner, a loop, a hook, or any suitable connector that allows the handle cord to slide past it. And, in other implementations, the frame handle cord direction guides may include a clip, a carabiner, a loop, a hook, or any suitable direction guide that constrains the directional path of the handle cord to which it is slidably coupled and along the surfaces of the guide that the handle cord slides along.

A handle damping spring 180 is coupled (e.g., with a connector) to the second end 192 of the handle cord 194, and a handle weight 184 is coupled (e.g., with a connector) to the handle damping spring 180 and the first end 198 of the handle spring 190.

The handle weight 184 has a known mass and exerts linear resistance to the user pulling the handle downwardly. The handle weights 184 shown are weight bags, but the handle weights may be any suitable weight for an exercise system, such as disc weights, barbells, or sandbags. In some implementations, a hydraulic, electric, or other system can be used to provide resistance instead of or in addition to the handle weight (e.g., hydraulic or electric pistons). The resistance of the handle damping spring 180 and the mass of the handle weights 184 may be varied depending on the user's preferences. The user can increase the amount of weight and/or use a higher resistance elastic band to add more resistance to the downward movement of the handle or reduce the amount of weight and/or use a lower resistance elastic band to reduce the resistance to the downward movement of the handle. In addition, the handle damping spring 180) and the handle weight 184 may be removed from the system 100, and the handle cord 194 may be directly coupled to the handle spring 190.

The handle damping spring 180 comprises an elastic band. However, in other implementations, the handle damping spring may be a coil spring or any other type of suitable spring. And, in other implementations, the handle damping spring can be replaced with graded hydraulic, electric, or other systems that provide resistive loads (e.g., hydraulic or electric pistons). The handle damping spring has a lower resistance than the handle spring in some implementations. For example, in some implementations, the handle damping spring may have a resistance that is ⅛ to ½ the resistance of the elastic band (e.g., a handle damping spring having a resistance of 10 lbs, and an elastic band having a resistance of 20 lbs, to 80 lbs.).

The central axes A, B of the handle guides 110, 120 are generally straight in the resting position. However, when force is applied to the handles 150, 160 by the user to move them along their respective handle guides 110, 120 in a downward direction shown as D in FIG. 2, the user moves the handle 110, 120 along an arcuate path 112 as viewed from a second vertical plane that includes the central axis A, B of the respective handle guide 110, 120 and is perpendicular to the first vertical plane as shown in FIG. 7. This arcuate path 112 is shown in FIG. 7. The force applied to the handle 110, 120 by the user moves the handle 110, 120 outwardly, away from the user, which bends the handle guides 110, 120 to which the force is applied about the handles 150, 160. Thus, the handle 150, 160 being moved by the user extends further from the user than when in the resting position. For example, when the user is using the arm movement system 100 to simulate the freestyle or front crawl stroke, the user pulls one handle 150, 160 at a time from the start of the pull portion to the end of the pull portion of the stroke. When the user reaches the end of the pull portion of the stroke, the user releases the downward force on the handle 110, 120, and the handle 150, 160 can move upwardly on the respective handle guide 110, 120 due to gravity acting on the handle weight 184. This upward movement of the handle 150, 160 may or may not follow an arcuate path. In addition, the handle 150, 160 that is not being pulled through the pull portion of the stroke can be held anywhere along the handle guide 110, 120 by the user applying sufficient force to the handle 150, 160 to overcome the force of gravity acting on the handle weight 184 coupled to that handle 150, 160. The movement of each handle 150, 160 downwardly along the handle guide and the arcuate path 112 shown in FIG. 7 mimics the path taken and resistance felt by the user's hand and arm during the pull phase of the freestyle or front crawl stroke, and the movement of each handle upwardly along the handle guide provides no resistance to the user's hand and arm, such as is experienced by a swimmer during the reach phase of the freestyle or front crawl stroke.

As the handle 150, 160 is moved downwardly, the handle weight 184 is urged upwardly, and the handle damping spring 180 slows the acceleration of the handle weight 184 by absorbing energy from the downward movement of the handle 150, 160, which creates a smoother transition in the amount of resistance perceived by the user to push the handle 150, 160 downwardly. And, when the handle 150, 160 reaches the bottom or top of its path along the handle guides 110, 120, the handle damping spring 180 absorbs the vibrational energy of the handle weight 184 from its movement upwardly or downwardly.

Because the handle guide cords are axially bendable and the ends of the cords are coupled to handle guide springs, the user can twist the handle 150, 160 about the central axis A, B of the respective handle guide 110, 120 and/or move the handle 150, 160 horizontally away from the second vertical plane.

The exercise system 10 also includes a restraint system adjacent each handle guide 110, 120. Each restraint system prevents the handle cords 194 and the handle weight 184 of the arm movement system 100 from swinging away from the handle guides 110, 120. Each restraint system includes a restraint guide 111 and a restraint system connector 113. At least a portion of the restraint guide 111 of each restraint system extends parallel to the central axes A, B of the handle guides 110, 120 of the arm movement system 100 when in the resting position. The restraint guide 111 of each restraint system is coupled to the adjacent vertical member 316, 318 of the vertically oriented frame. The restraint system connector 113 of each restraint system is statically coupled to the adjacent handle cord 194 and is slidably coupled to the respective restraint guide 111 such that the restraint system connector 113 slides along the restraint guide 111. In the implementation shown in FIGS. 1 and 7, each restraint guide 111 is a static cord, and the restraint system connector 113 includes a single wheel pulley 115 and a restraint cord 117 that extends between the single wheel pulley 115 and the respective handle cord 194. The restraint cord 117 is coupled (e.g., tied) to the respective handle cord 194 and the single wheel pulley 115, and the restraint system connector 113 moves along the static cord 117 as the respective handle cord 194 is moved up and down relative to the static cord 117. Although each restraint guide 111 shown in FIGS. 1 and 7 is a cord, in other implementations, the restraint guide may be a wire, an elongated piece of plastic, metal, or combination thereof, or other suitable elongated guide that allows the restraint system connector to slide along it as the handle is moved along the handle guide. The restraint system connector 113 shown in FIGS. 1 and 7 is a single wheel pulley 115 and a cord 117, but in other implementations, the restraint system connector may not include the cord and just includes a single wheel pulley that is coupled at the end opposite the wheel to the handle cord of the arm movement system, or the restraint system connector may not include the single wheel pulley and just include a clip, carabiner, hook, loop, or other suitable connector that allows the restraint system connector to slide along the restraint guide but remain statically coupled to the handle cord of the arm movement system. And in other implementations, the restraint system connector may include clips, carabiners, hooks, loops, or other suitable connectors instead of a single wheel pulley that are coupled to a cord or to another clip, carabiner, hook, loop, or other suitable connector.

The horizontally oriented frame 320 comprises a stationary platform 330 and horizontal support members. The stationary platform 330 is spaced apart from the support surface 12 (e.g., ground or floor) on which the system 10 is disposed by horizontal frame members and extends generally horizontally relative to the support surface. The stationary platform 330 may be parallel with the ground or floor or it may lie within a plane that is at an angle of less than 30° to the ground or floor. The horizontal frame members may also prevent the stationary platform 330 from bending in response to a user standing on the stationary platform 330 or a structure coupled thereto. The stationary platform 330 shown in FIGS. 1, 3A-4, and 7 is a rigid sheet material, such as plywood, metal, or plastic, but in other implementations, the stationary platform may include rigid members that extend at transverse angles to each other, and an upper surface of the rigid members are within a plane configured for supporting a rotatable platform of the torso movement system, which is described below.

The horizontally oriented frame 320 comprises four horizontal frame members comprising a rigid material that are coupled together (e.g., by fasteners) into a rectangular arrangement. A plane that extends through the rectangular arrangement of the horizontal rigid members is parallel to the support surface 12 upon which the horizontal frame members are to be disposed. However, in other implementations, the plane may be at an angle of 0° to 30° from the support surface. In the implementation shown in FIGS. 1 and 7, the horizontal frame members are wooden 2×4s that are coupled together by nails. However, in other implementations, the horizontal frame members may include other rigid materials, such as metal or plastic, and/or other fasteners, such as screws, ties, clips, adhesive, or other suitable fastener for securing the horizontal frame members in the rectangular or other shaped arrangement. In addition, although the horizontal frame members are coupled together in a rectangular configuration in FIGS. 1 and 7, the horizontal frame members may include two or more horizontal frame members and be coupled in an I, H, or X configuration or any configuration suitable for supporting the stationary platform above the support surface while supporting the weight of the user. In other implementations, the stationary platform may be removably coupled to the rigid horizontal support members. And, in further or additional implementations, the horizontal frame members may be telescoping, which allows the horizontal frame members to reduce the volume that they occupy in a collapsed configuration, as described above with respect to the vertical frame members.

In other implementations, the members of the horizontally oriented frame may be coupled together to allow for the members to be collapsed into a footprint that is smaller than when in use (e.g., using hinges, telescoping members, and/or other suitable mechanisms for allowing the members to be arranged into a smaller footprint).

In some implementations, the horizontally oriented frame and the vertically oriented frame are coupled together (e.g., removably, hingedly, or otherwise) such that the frames may be folded or otherwise collapsed relative to each other to occupy a smaller volume than when in use.

The torso movement system 200 is disposed on a surface of the stationary platform 330 that faces away from the support surface 12 on which the system 100 is disposed. The torso movement system 200 as shown in FIGS. 1, 3A-4, and 7 includes a rotatable platform 270, a ring bearing 280, a first platform cord 272, a second platform cord 273, a torso weight 274, a track 276, a torso weight connector 278, and a torso weight damping spring 290.

The rotatable platform 270 has a rotational axis E about which it is rotatable. The rotatable platform 270 is coupled to the stationary platform 330 such that the rotatable platform 270 is rotatable about the rotational axis E relative to the stationary platform 330. The rotatable platform 270 is positioned such that the rotational axis E of the rotatable platform 270 is parallel to the central axis A, B of each handle guide 110, 120 when the handles 150, 160 are in the resting position. The rotatable platform 270 is disposed adjacent the handle guides 110, 120 such that a user having the user's body supported by the rotatable platform 270 can reach the handles 150, 160 with the user's hands. Although the central axes A, B of the handle guides 110, 120 when in the resting position and the rotational axis E of the rotatable platform 270 are parallel to each other, in other implementations, the central axes of the handle guides when in a resting position can be at a transverse angle with respect to the rotational axis of the rotatable platform.

In the implementation shown in FIGS. 1, 3A-4, and 7, the rotatable platform 270 is a circular platform, and the rotational axis E is the central axis of the circular platform, but in other implementations, the rotatable platform is a square platform, a rectangular platform, or any shape suitable for receiving the user's feet or another device for supporting the user's body (e.g., a chair or wheelchair for users that cannot or wish to not stand) and allowing the user to rotate his/her body about the rotational axis of the rotatable platform.

Figure 3B:
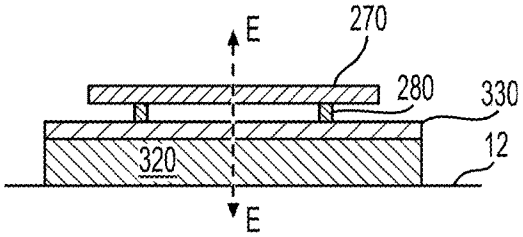
FIG. 3B is a cross sectional view of the torso movement system shown in FIG. 3A as viewed through the 3B-3B line.
Figure 9:
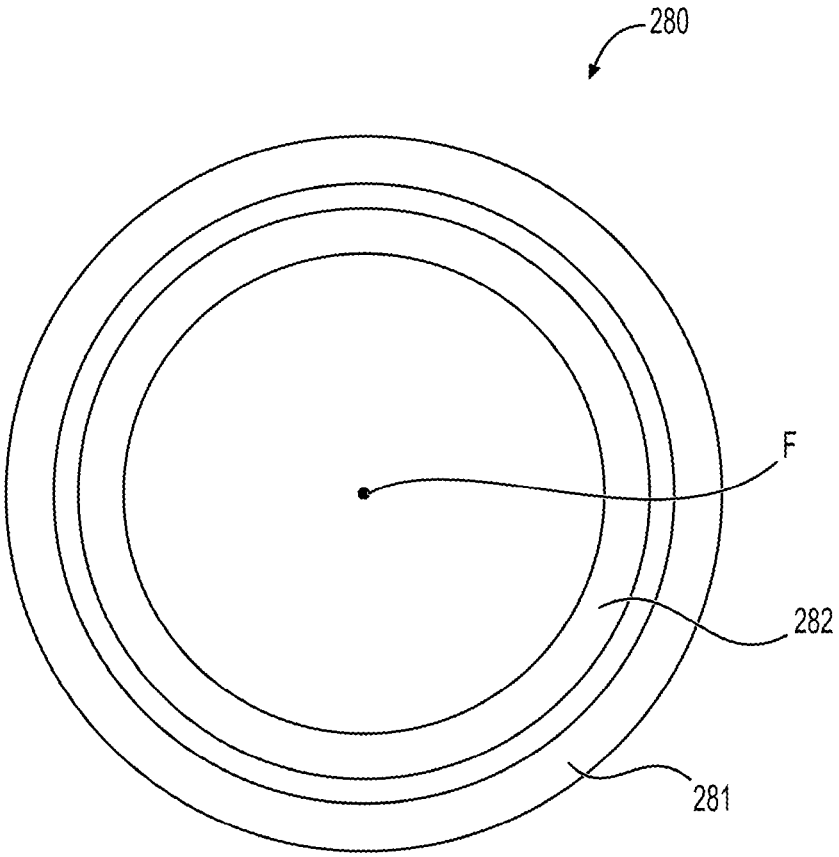
FIG. 9 is a top view of a ring bearing, according to one implementation.

The ring bearing 280 is coupled between the rotatable platform 270 and the stationary platform 330 to allow the rotatable platform 270 to rotate relative to the stationary platform, as shown in FIG. 3B. The ring bearing 280, which is shown in FIG. 9, includes a first ring 281 and a second ring 282. At least one of the rings 281, 282 are rotatable separately from the other around a central axis F of the ring bearing 280. When coupled to the rotatable platform 270, the central axis F of the ring bearing 280 is coaxial with the rotational axis E of the rotatable platform 270. One of the rings 281, 282 is coupled to the stationary platform 330, and the other ring 282, 281 of the ring bearing 280 is coupled to the rotatable platform 270. The first and second rings 281, 282 are radially disposed relative to each other, but in other implementations, the rings are axially disposed relative to each other. In other implementations, the torso movement system includes a ball bearing system or any other kind of bearing mechanism suitable to allow for relative rotation of the rotatable platform with respect to the stationary platform.

The rotatable platform 270 includes a first surface that is coupled to the ring bearing and a second surface that faces away from the ring bearing and supports the user. The second surface may include a frictional coating or pad on at least a portion thereof to prevent the user's feet from slipping on the rotatable platform 270.

Figure 3C:
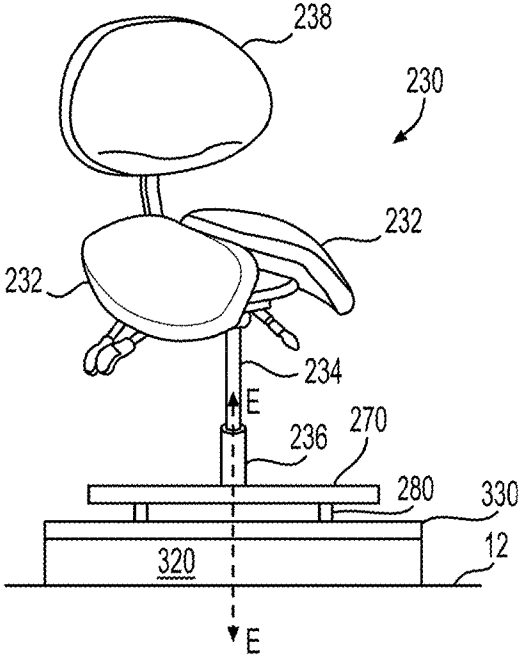
FIG. 3C is an end view of a torso movement system, according to another implementation.
Figure 3A:
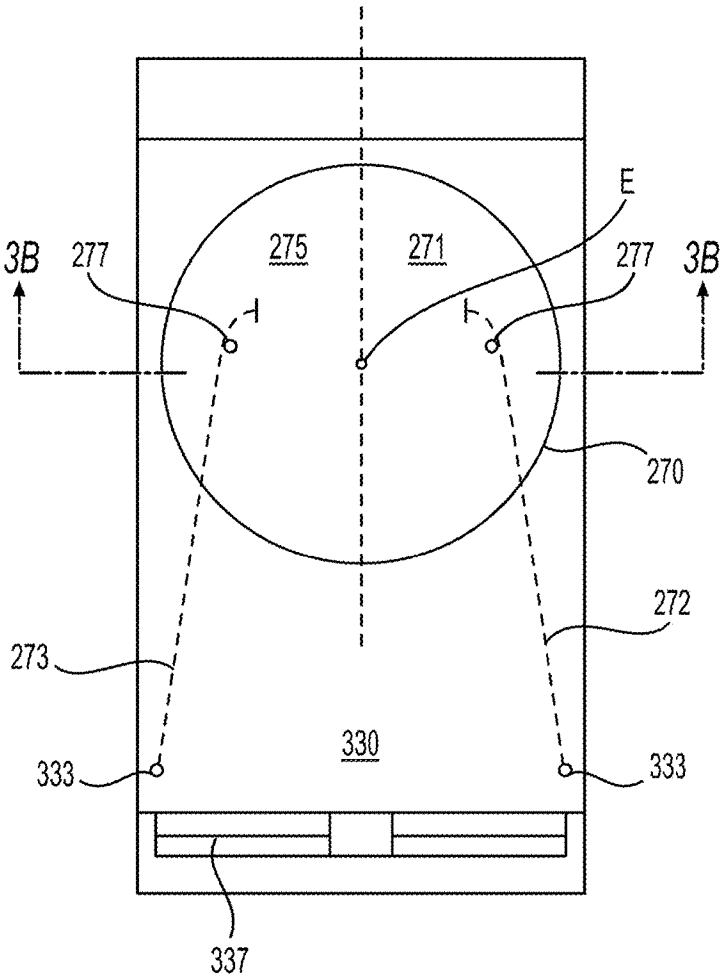
FIG. 3A is a top view of a torso movement system of the exercise system FIG. 1.

In some implementations, such as the implementation shown in FIG. 3C, a chair 230 is coupled to the second surface of the rotatable platform 270 and is configured to support the user. The chair shown in FIG. 3C is a saddle chair 230 and includes a first leg portion 234, a second leg portion 236, two seat portions 232, and a back rest 238.

The second leg portion 236 is coupled to the second surface of the rotatable platform 270, and the first leg portion 234 is coupled to the two seat portions 232. The second leg portion 236 has a tubular shape that defines a central longitudinal opening. The first leg portion 234 is sized to be disposed within, and slidably adjustable in, the central longitudinal opening of the second leg portion 236 such that a distance between the seat portions 232 and the second surface of the rotatable platform 270 is adjustable. However, in some implementations, the second leg portion is sized to be disposed within, and slidably adjustable in, a central longitudinal opening of the first leg portion such that a distance between the seat portions and the second surface of the rotatable platform is adjustable.

Each of the two seat portions 232 are hingedly coupled to the first leg portion 234 such that the angle of a surface of each of the seat portions 232 relative to the second surface of the rotatable platform 270 is adjustable. This adjustability allows a user (e.g., a user with limited or no use of their legs) to stabilize the user's body on the seat portions 232, and thus, on the rotatable platform 270, without using their legs. A back rest 238 is coupled to the seat portions 232 and the first leg portion 234 to better stabilize the user. The saddle chair 270, or any other implementation of a chair, can also include a seatbelt to better secure the user. In some implementations, the back rest is coupled to one of the seat portions, both of the seat portions, or the first leg portion.

The saddle chair 230 provides a user with a leg(s), hip(s), or nervous system injury that limits or prevents movement of the user's legs with the ability to perform a full upper body workout with the core, latissimus dorsi, shoulder, arm, and hand resistance. The rotating table of the disclosed device would be difficult to use in a typical seated position because the user's knees could interfere with the handle guides during rotation. However, the saddle chair is tall enough that the user's legs could be extended to keep the user's knees under the user. The saddle aspect of the chair with legs positioned on either side of the chair hold the user's torso in an upright facing position. The saddle, with a leg on either side, holds the user vertically and stabilized on the chair while the user works out the user's upper body and core. The user is able to accomplish a full upper body, core aerobic workout in the same way a swimmer could use the rotating table to get a "pulling" workout without the kicking device. Musculature in the back and flexibility of the swimming workout is one of the best possibilities for aerobic strength building. With the addition of a seat belt/shoulder harness, a person without use of the person's legs to hold the person in the seat can also use this device.

The rotatable platform 270 includes a first portion 271 and a second portion 275. The first portion 271 and the second portion 275 of the rotatable platform 270 are separated by a plane that includes the rotational axis E. A first end of the first platform cord 272 is coupled to the first portion 271 of the rotatable platform 270, and a first end of the second platform cord 273 is coupled to the second portion 275 of the rotatable platform 270. Each of the first portion 271 and the second portion 275 of the rotatable platform 270 define at least one opening 277 through which the respective platform cord 272, 273 passes for coupling the platform cord 272, 273 to the rotatable platform 270. In the implementation shown, the openings 277 are spaced apart from the rotational axis E of the rotatable platform 270 the same distance and are disposed along a chord that is perpendicular to the plane that includes the rotational axis E. In other implementations, each platform cord is coupled to the respective portion of the rotatable platform using any suitable fastener such as eye hooks, loops, or staples.

The handle cords 194, handle connector cords 182, restraint cords 111, 117, and platform cords 272, 273 are nylon paracord. However, in other implementations, these cords are any material that is axially bendable and is not stretchable or is significantly less stretchable than the elastic bands.

The torso weight 274 provides a resistive force against rotational movement of the rotatable platform 270 about the rotational axis E. The torso weight 274 is coupled to the rotatable platform 270 by the first platform cord 272 and the second platform cord 273. Second ends of each of the platform cords 272, 273 are coupled to the torso weight 274.

The torso weight 274 has a known mass and exerts linear resistance against a lifting force on the torso weight 274. The torso weight 274 shown in FIGS. 1, 2, and 7 is a bag weight. However, in other implementations, the torso weight can be any weight such as a bar bell weight, or any other weight suitable for providing the resistive force against rotational movement of the rotatable platform about the rotational axis. The user can increase the amount of weight to add more resistance to the rotational movement or reduce the amount of weight to reduce the resistance to the rotational movement.

The torso weight damping spring 290 is coupled directly to the torso weight 274 and extends between the torso weight 274 and the stationary platform 330. The torso weight damping spring 290 of the torso movement system 200 comprises an elastic band. Similar to the arm movement system 100, the resistance of the torso weight damping spring 290 and the mass of the torso weight 274 may be varied depending on the user's preferences. As noted above, in other implementations, the torso damping spring may be a coil spring or any other type of suitable spring. In other implementations, the torso damping spring and/or weight can be replaced by a system for creating resistance, such as hydraulic or electric resistance systems (e.g., hydraulic or electric pistons), against rotational movement of the rotatable platform about the rotational axis.

The rotatable platform 270 is biased into a start position. In the start position shown in FIGS. 1 and 3A, the plane that includes the rotational axis E and divides the rotatable platform 270 into two portions 271, 275 is perpendicular to the vertical plane that includes the central axes A, B of the handle guides 110, 120 when the handles 150, 160 are in the resting position. In the start position, the torso weight 274 is at rest at the lowest point of the arcuate portion 279 of the track 276. When the user is supported by the rotatable platform 270 (e.g., standing on the rotatable platform 270) while it is in the start position, the user aligns his or her coronal plane to be parallel with the first vertical plane, and the user does not feel any resistance from the rotatable platform 270. However, resistance is felt by the user as the user rotates the rotatable platform 270 away from the start position to an angular position spaced apart from the start position (e.g., greater than 0° and less than 90° from the start position, such as, for example, up to 15° from the start position, up to 30° from the start position, up to 45° from the start position, up to 60° from the start position, or up to 75° from the start position) due to the torso weight 274 being moved up the track 276 against gravity. As the rotatable platform 270 is rotated counter-clockwise from the start position, the torso weight 274 is urged upwardly along one side of the track 276 (e.g., the user's right side if standing on the rotatable platform 270) with the track 276 behind the user), and as the rotatable platform 270 is rotated clockwise from the start position, the torso weight 274 is urged upwardly along the other side of the track 276 (e.g., the user's left side if standing on the rotatable platform 270) with the track behind the user). As the rotatable platform 270 rotates from a position away from the start position toward the start position, little or no resistance is felt by the user since the torso weight 274 is moving down the track 276 due to gravity. This movement of the torso weight 274 down the track creates momentum for the torso weight 274 to start its upward path on the other side of the track 276, which helps the user transition to rotating from the start position toward the other direction. The torso weight damping spring 290 slows the acceleration of the torso weight 274 by absorbing energy as the rotation changes direction through the start position, which creates a smoother transition in the amount of resistance perceived by the user as the user is moving the rotatable platform through the start position toward the other rotational direction.

The track 276 is an aluminum bar having a first end 291, a second end 292, and an arcuate shaped portion 279 disposed between the first end 291 and the second end 292. A center of the arcuate shaped portion 279 is in a plane closer to the support surface 12 than the ends 291, 292 of the track 276. The torso weight 274 is slidably coupled to the track 276 via a torso weight connector 278 such that movement of the torso weight 274 toward the first end 291 or the second end 292 from the center of the arcuate shaped portion 279 creates potential energy.

If the user is using the torso movement system 200 with the arm movement system 100, the user isometrically engages his or her torso muscles to keep the user's hips aligned with the shoulders while moving the handles 150, 160 along the handle guides 110, 120. This arm movement and the isometric engagement of the torso muscles transfers rotational force through the user into the rotatable platform 270. For example, as shown in FIG. 7, the user is pushing on the handle 150 with the user's right hand and arm, which causes the user's right hip to rotate away from the handle guides 110, 120, turning the rotatable platform 270 clockwise. Similarly, if the user is pushing the handle 150 with the user's left hand and arm, the user's left hip is rotated away from the handle guides 110, 120, turning the rotatable platform 270) counterclockwise. If the user uses the torso movement system 200 by itself, the user may actively engage his/her torso muscles (twist the hips with respect to the shoulders) to provide rotational force to the rotatable platform 270. In either use, as the torso weight 274 slides back toward the center of the arcuate shaped portion 279 as the rotatable platform 270) approaches the start position, momentum is created by gravity acting on the torso weight, which makes the transition between rotating in each direction from the start position smoother for the user.

Although the track 276 is formed from aluminum in this implementation, in other implementations, the track can be formed from polymer, wood, another metal, or any other rigid material suitable to provide a track for guiding the movement of the torso weight.

The track 276 is coupled to a vertical portion of the horizontally oriented frame 320, which extends vertically relative to the horizontal frame members and stationary platform 330. The vertical portion includes two vertically oriented frame members 335, 336 that are coupled adjacent to an end of the stationary platform 330 (e.g., to the stationary platform and/or to the frame members to which the stationary platform is coupled) that is spaced furthest away from the vertically oriented frame. The vertical portion also includes a horizontal support member 337 that extends between upper ends of the vertically oriented frame members 335, 336. However, in other implementations, the vertical portion may not include the horizontal support member or may include one arcuate shaped frame member that is coupled adjacent the distal end of the stationary platform and adjacent each side edge of the stationary platform.

The torso weight connector 278 is directly coupled to the torso weight 274 and the second ends of first and second platform cords 272, 273. The torso weight 274 hangs from the torso weight connector 278 and below the track 276. The torso weight connector 278 moves (e.g., slides, rolls) along the track 276 as the rotatable platform 270 is rotated about the rotational axis E. In other implementations, the torso weight connector may be indirectly coupled to the handle weight via a cord or another connector. The torso weight connector in FIGS. 1 and 7 includes a single wheel pulley that rolls along the track 276. However, in other implementations, the torso weight connector may include a clip, carabiner, hook, loop, or other suitable connector that allow the torso weight connector to slide along the track but remain statically coupled to the platform cords of the torso movement system.

Figure 4:
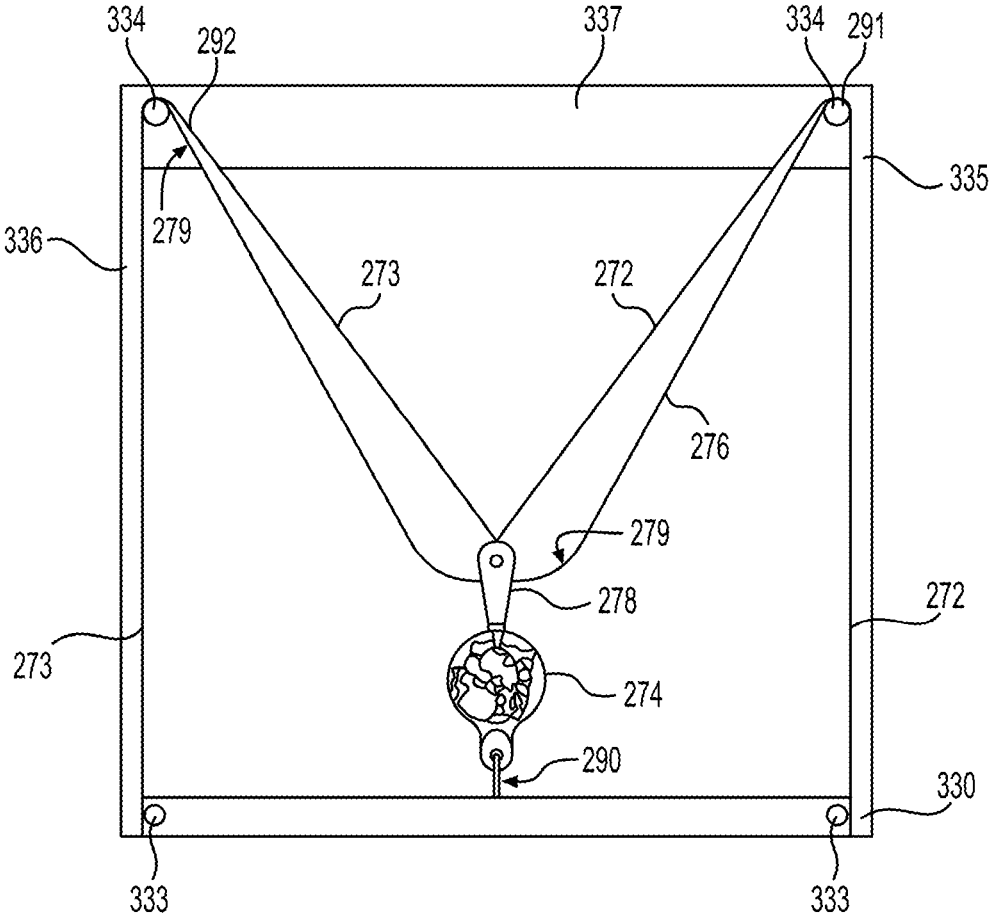
FIG. 4 is a rear view of the torso movement system of the exercise system shown in FIG. 3A.

Each platform cord 272, 273 extends along a path between the rotatable platform 270 and the torso weight 274. A first portion of each path extends from the rotatable platform 270 in a direction away from the arm movement system 100 and toward the vertical portion of the horizontally oriented frame 320 to which the track 276 is coupled and to which a respective first platform cord direction guide 333 is coupled. The first platform cord direction guides 333 are disposed below the arcuate portion 279 of the track 276 in FIGS. 1 and 7, but the first platform cord direction guides 333 may be disposed above this portion in other implementations. A second portion of each path extends vertically between the respective first platform cord direction guide 333 and a respective second platform cord direction guide 334 is that is disposed vertically above the respective first platform cord direction guide 333 and above or at the same level as the respective adjacent end 291, 292 of track 276. A third portion of the path extends from the second platform cord direction guide 334 to the torso weight 274. The first and second platform cord direction guides 333, 334 change the direction of the respective platform cord 272, 273 and allow the respective platform cord 272, 273 to slide relative to the platform cord direction guides 333, 334 such that each respective platform cord 272, 273 extends from the rotatable platform toward the track 276, then upwardly to (or above) the ends of the track, and then downwardly and inwardly toward the torso weight 274 such that the cords 272, 273 can pull the torso weight 274 up the track depending on which cord 272, 273 is being pulled away from the torso weight 274 by rotation of the rotatable platform 270. The platform cord direction guides 333, 334 in FIGS. 1, 4, and 7 are single wheel pulleys, but in other implementations, the platform cord direction guides may be a clip, a carabiner, hook, loop, or other suitable mechanism for restraining the direction of the platform cord while allowing it to slide relative to the cord guide.

In the implementation shown in FIGS. 1, 3A-3B, and 7, rotatable platform 270 is formed from wood. But, in other implementations, the rotatable platform may include other rigid materials, such as metal or plastic.

FIGS. 1 and 7 show the arm movement system 100 and the torso movement system 200 provided in combination with each other. However, in other implementations, the arm movement system and the torso movement system can be provided and/or used separately.

Figure 8A:
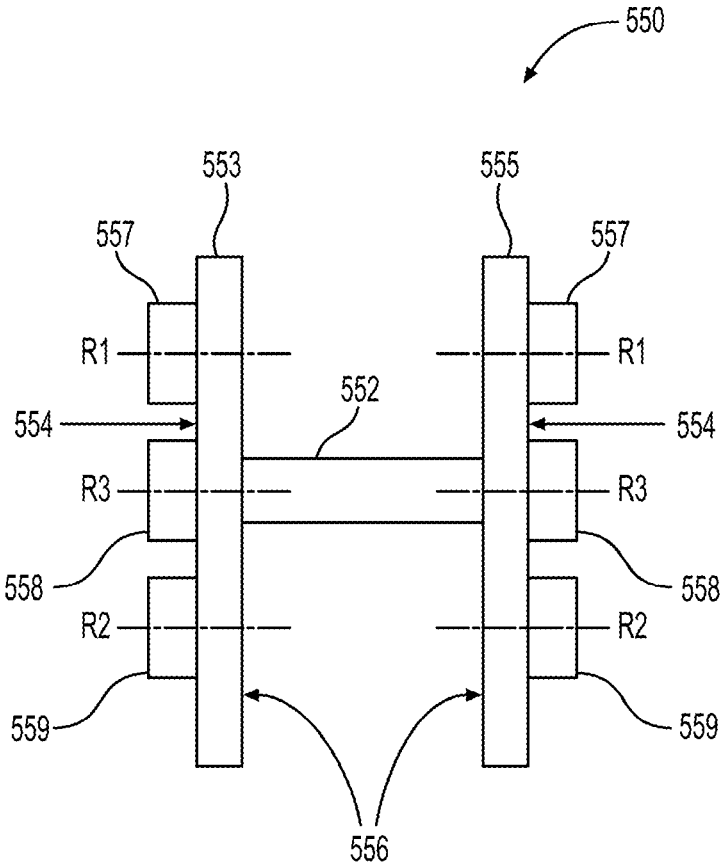
FIG. 8A is a front view of a handle according to another implementation.
Figures 8B, 8C:
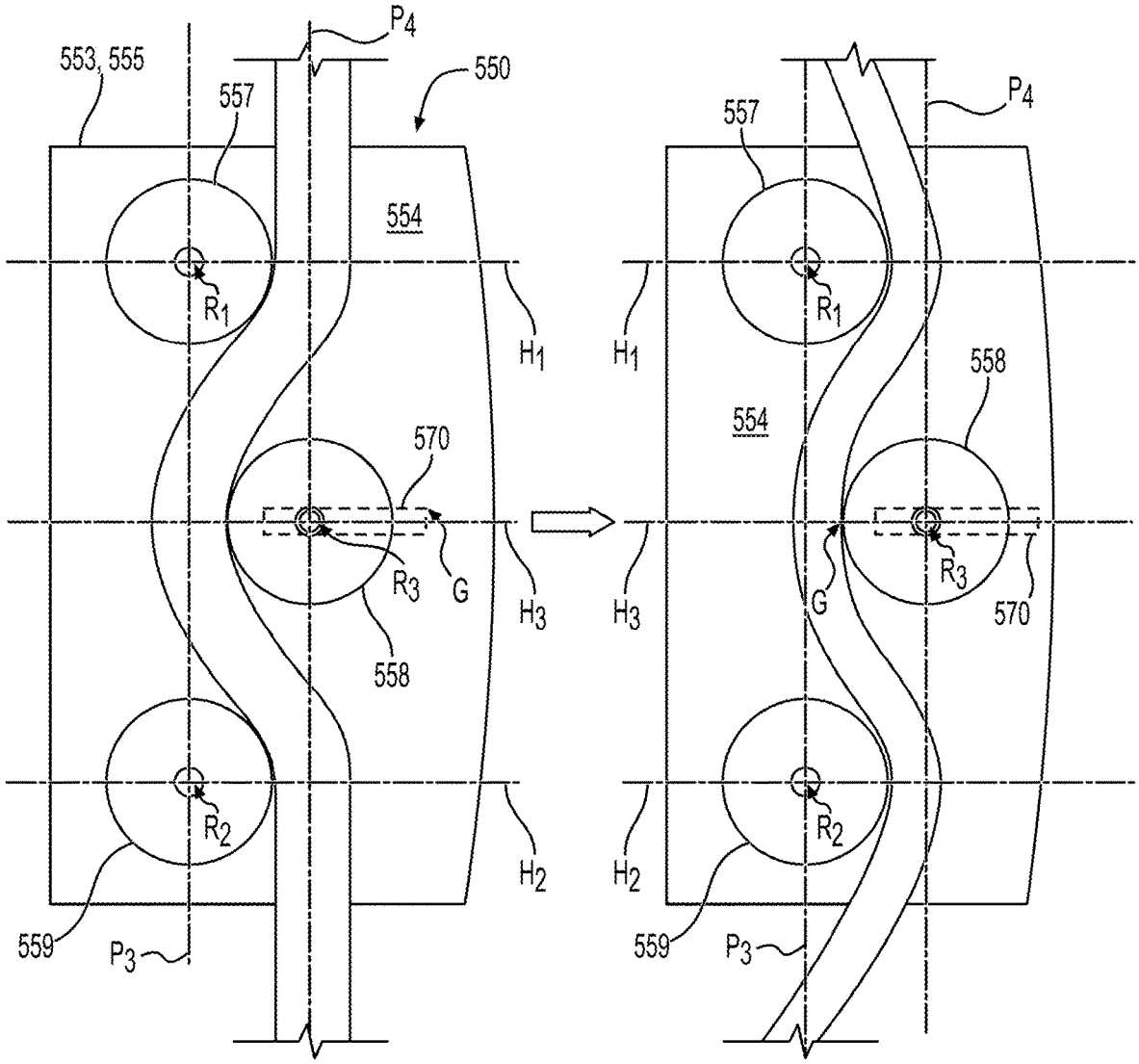
FIG. 8B is a side view of the handle shown in FIG. 8A in the resting position.
FIG. 8C is a side of the handle shown in FIG. 8A while being pushed on by the user.

In the implementation shown in FIGS. 1-7, the handle 150, 160 includes tubes arranged in an H-shaped configuration to slide along the respective handle guide 110, 120. However, other implementations include handles that have a rolling interface with the respective handle guide, and the frictional resistance between each respective handle and handle guide is adjustable. For example, as shown in FIGS. 8A-8C, a handle 550 according to another implementation has a central bar 552 and two plates 553, 555. Each plate 553, 555 is associated with a cord (e.g., handle cords 130, 140) of the respective handle guide (e.g., handle guides 110, 120). Each plate 553, 555 lies in a plane that is parallel to the central axis (e.g., central axes A, B) of the handle guide (e.g., handle guides 110, 120) and has a first surface 554 that faces away from the other plate 553, 555 and a second surface 556 that faces toward the other plate 553, 555. Three pulley wheels 557, 558, 559 are rotatably coupled to each of the first surfaces 554, and the rotational axes R of each pulley wheel 557, 558, 559 are perpendicular to the plate 553, 555. For example, the pulley wheels 557, 558, 559 may be coupled to the plate 553, 555 with a bolt and/or rivet. The rotational axes R1, R2 of the first and second pulley wheels 557, 559 lie within a third vertical plane P3 that is parallel to the first vertical plane and perpendicular to the second surface 556 of the plate, and the rotational axis R3 of the third pulley wheel 558 lies in a fourth vertical plane P4 that is spaced apart from and is parallel to the third vertical plane P3. In addition, each rotational axis R1, R2, R3 extends within a horizontal plane H1, H2, H3 that is perpendicular to the central axis of the handle guide, and each horizontal plane H1, H2, H3 is spaced apart from the other such that the horizontal plane H3 that includes the rotational axis R3 of the third pulley wheel 558 is disposed between the horizontal planes H1, H2 that includes the rotational axes R1, R2 of the first and second pulley wheels 557, 559. The respective handle guide cord (e.g., handle guide cords 130, 140) extends between the third vertical plane P3 and the fourth vertical plane P4 such that the pulley wheels 557, 558, 559 roll along the respective handle guide cord as the handle 550 is moved up or down. The frictional force between the respective handle guide cords and the pulley wheels 557, 558, 559 is sufficient to keep the handle in place unless the user overcomes this frictional force to move the handle 550. In addition, the frictional force between the respective handle guide cords and the pulley wheels 557, 558, 559 increases as the distance between the handle 550 and the first vertical plane increases, which increases the resistance felt by the user when moving the handle in an outward and downward direction.

In the implementation shown, the third pulley wheel 558 is coupled to the plate 553, 555 by extending its axle through a slot 570 defined in the plate 553, 555 that has a longitudinal axis G that is perpendicular to the third vertical plane P3 and lies within the third horizontal plane H3, which allows the rotational axis R3 of the third pulley wheel 558 to be moved closer to or further away from the third vertical plane P3. Moving the third pulley wheel 558 closer to the third vertical plane P3 increases the friction of the pulley wheels on the handle guide cord, and moving the third pulley wheel 558 away from the third vertical plane P3 decreases the friction of the pulley wheels on the handle guide cord.

Figure 8D:
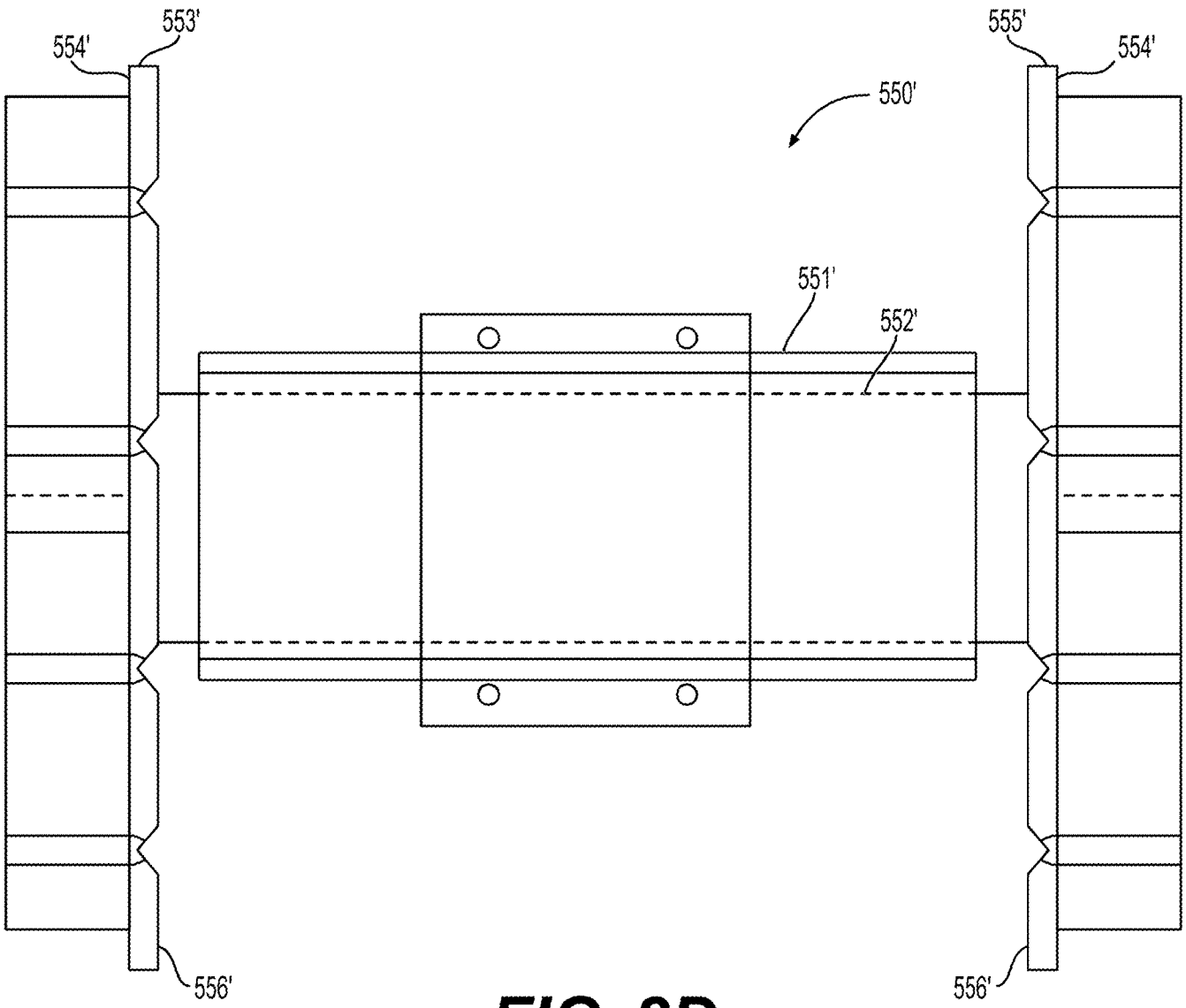
FIG. 8D is a front view of a handle according to another implementation.
Figure 8E:
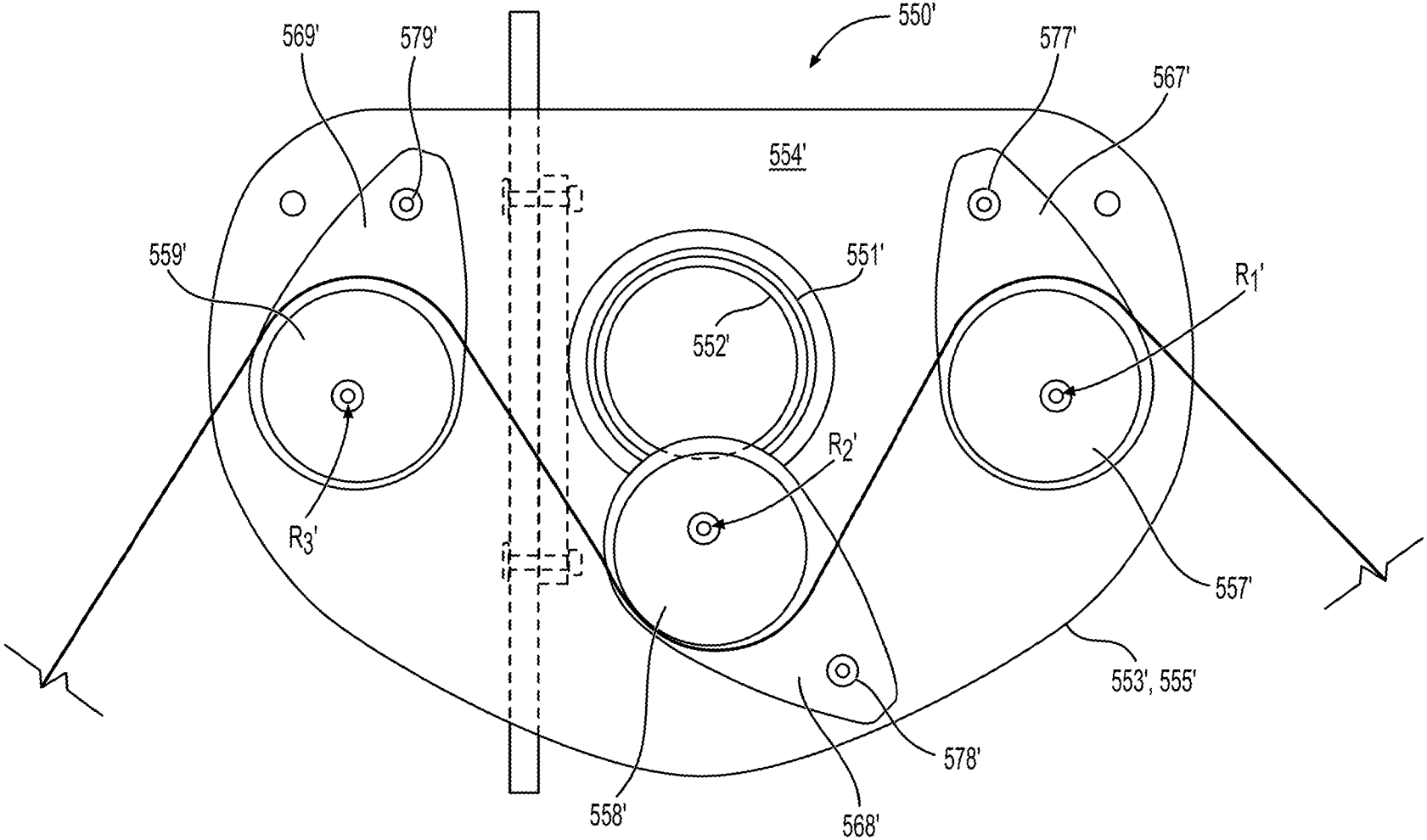
FIG. 8E is a side view of the handle shown in FIG. 8D.

FIGS. 8D and 8E shows another implementation of a handle 550' that, similar to the handle shown in FIGS. 8A-8C, has an inner central bar 552' and two plates 553', 555'. However, the handle shown in FIGS. 8D and 8E further includes an outer central bar 551' that is tubular-shaped. The inner central bar 552' is disposed within the outer central bar 551' such that the outer central bar 551' is rotatable about the inner central bar 552'. The user can grip the outer central bar 551' during use to allow the user's hand to rotate relative to the handle guides 110, 120 throughout a stroke. This motion mimics a swimmer's hand as it passes through the water.

Each plate 553', 555' is associated with a cord (e.g., handle cords 130, 140) of the respective handle guide (e.g., handle guides 110, 120). Each plate 553', 555' lies in a plane that is parallel to the central axis (e.g., central axes A. B) of the handle guide (e.g., handle guides 110, 120) and has a first surface 554' that faces away from the other plate 553', 555' and a second surface 556' that faces toward the other plate 553', 555'. Three rotation arms 567', 568', 569' each include a rotation point 577', 578', 579' at which the rotation arms 567', 568', 569' are rotatably coupled to the first surface 554' of each plate 553', 555'. Pulley wheel 557' is rotatably coupled to a portion of rotation arm 567' that is spaced apart from the rotation point 577' of the rotation arm 567'. Pulley wheel 558' is rotatably coupled to a portion of rotation arm 568' that is spaced apart from the rotation point 578' of the rotation arm 568'. Pulley wheel 559' is rotatably coupled to a portion of rotation arm 569' that is spaced apart from the rotation point 579' of the rotation arm 569'. The rotational axes R1', R2', R3' of each pulley wheel 557', 558', 559' are perpendicular to the respective plate 553', 555'. For example, the rotation arms 567', 568', 569' may be coupled to the plate 553', 555' with a bolt and/or rivet, and the pulley wheels 557', 558', 559' may be coupled to the rotation arms 567', 568', 569' with a bolt and/or rivet.

Because the rotation arms 567', 568', 569' are rotatable relative to the respective plate 553', 555' to move the pulley wheels 557', 558', 559', the rotational axes R1', R2', R3' of each of the pulley wheels 557', 558', 559' move relative to each other between the plates 553', 555'.

The respective handle guide cord (e.g., handle guide cords 130, 140) extends between the vertical planes such that the pulley wheels 557', 558', 559' roll along the respective handle guide cord as the handle 550' is moved up or down. The frictional force between the respective handle guide cords and the pulley wheels 557', 558', 559' is sufficient to keep the handle in place unless the user overcomes this frictional force to move the handle 550'. In addition, the frictional force between the respective handle guide cords and the pulley wheels 557', 558', 559' increases as the distance between the handle 550' and the first vertical plane increases, which increases the resistance felt by the user when moving the handle in an outward and downward direction.

The pulley wheels on the handles described herein are effective in providing feedback to the hands of the user as the handle guide angle changes. While the handle guides give effective increasing resistance to the swimmer's large muscles (e.g., arm/shoulder/forearm and latissimus dorsi muscles), the feedback from the pulley wheels mimics the micro feedback from a swimmer's hands created by the viscosity (water pressure on the fingers) of the water they are passing through. Swimmers are able to regulate the acceleration of the large muscle movement by the amount of viscosity the hand feels as it moves to optimize the arm speed and "catch" the most mass of water effectively. By the feeling of the viscosity of the water, the hand of a trained swimmer is constantly measuring and adjusting their hand arm speed through the swimmer's stroke to accommodate for the feeling of water "caught" in their hand.

As shown in FIGS. 8A-8E, the handle guide makes a zigzag angled path through the pulley wheels. The angles defined by adjacent portions of the path may be increased or decreased depending on the preference of the user or swim coach. The pulley wheels set up a vibration through the plates to which they are mounted. This vibration is transferred effectively through the metal-to-metal contact of the plate, the inner central bar, the outer central bar, and the paddle assembly. In some implementations, the plates comprise aluminum, which has excellent sympathetic resonance characteristics, so the vibration is very noticeable to the user for the proper training of a swimmer's hand.

Figure 5A:
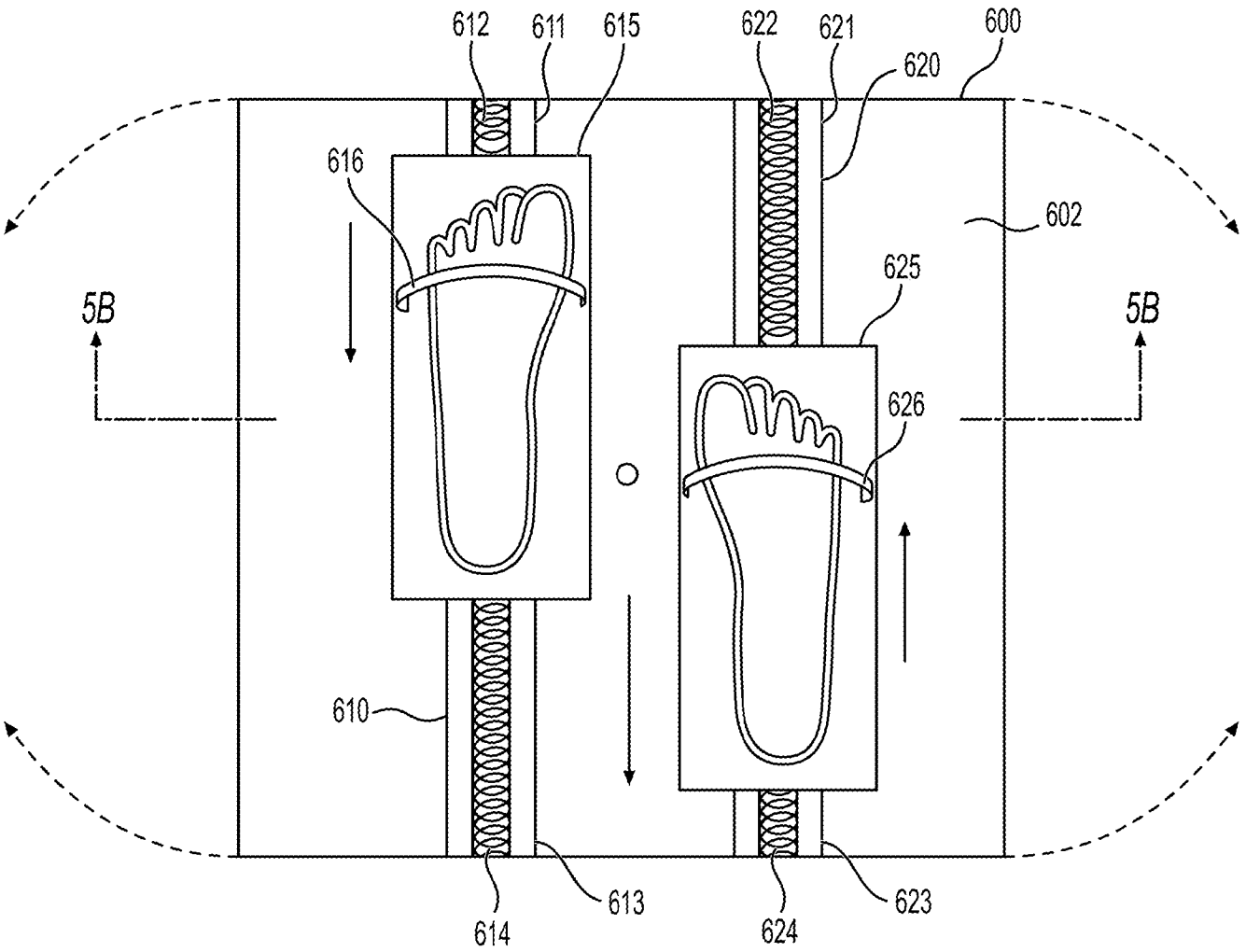
FIG. 5A is a top view of a kicking mechanism for use with the exercise system in FIG. 1, according to some implementations.
Figure 5B:
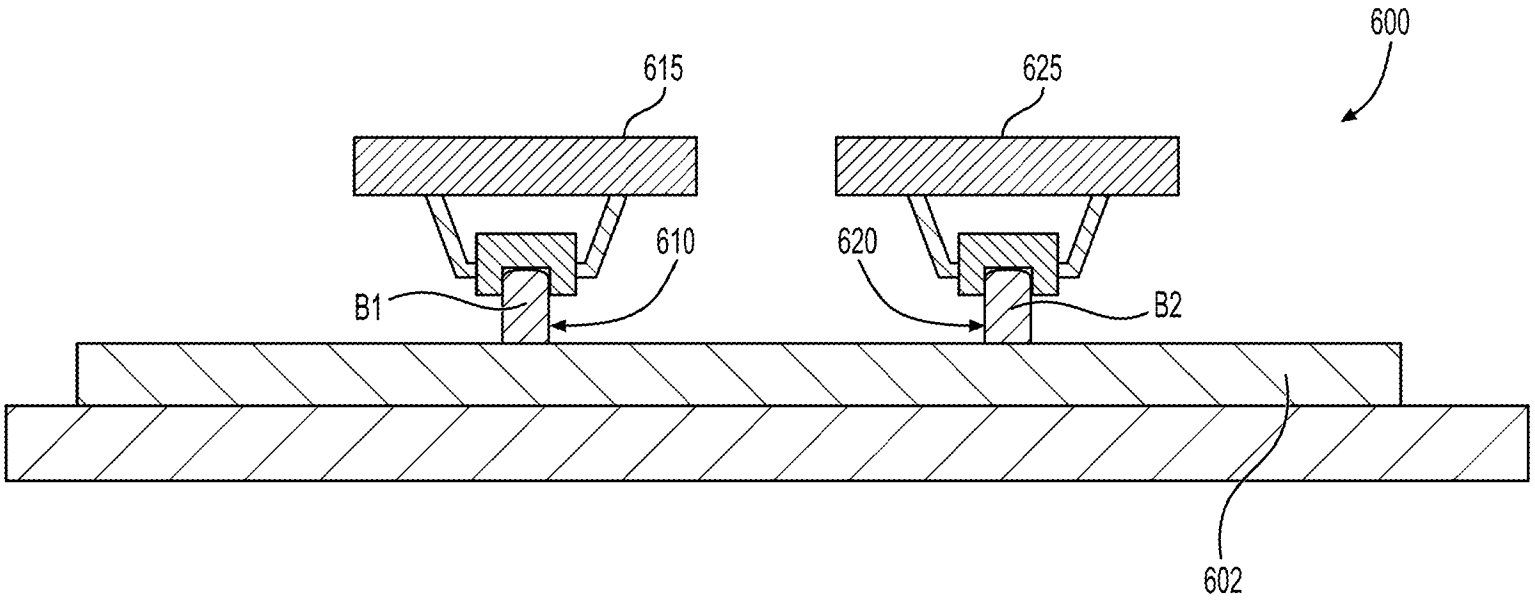
FIG. 5B is a cross-sectional view of the kicking mechanism shown in FIG. 5A as taken through the 6-6 line.

FIGS. 5A and 5B show a kicking mechanism 600, which can be coupled to the rotatable platform (e.g., rotatable platform 270). The kicking mechanism 600 allows a user to move his or her feet individually to simulate a kicking motion of a swimmer. The kicking mechanism 600 includes a left pedestal track 610, a right pedestal track 620, a left pedestal 615, a right pedestal 625, a first and a second left pedestal spring 612, 614, a first and second right pedestal spring 622, 624, a left strap 616, and a right strap 626. Each pedestal track 610, 620 includes a first end 611, 621 and a second end 613, 623. The left pedestal track 610 and the right pedestal track 620 extend parallel to each other and are disposable on the surface of the rotatable platform (e.g., rotatable platform 270) that faces away from the support surface 12. Each pedestal 615, 625 is a platform having a surface area to support a foot of an average user. The left pedestal 615 is slidably coupled to the left pedestal track 610, and the right pedestal 625 is slidably coupled to the right pedestal track 620. Each of the left and right pedestals 615, 625 include bearings that couple to the tracks 610, 620 and allow the pedestals 615, 625 to move along an axis that extends between the first end 611, 621 and the second end 613, 623 of each respective track 610, 620. The user places his or her left foot on the left pedestal 615 and his or her right foot on the right pedestal 625. The straps 616, 626 are provided to secure the user's feet in a desired position on the respective pedestal 615, 625. The left strap 616 is coupled to the left pedestal 615, and the right strap 626 is coupled to the right pedestal 625.

The pedestals 615, 625 are coupled to the tracks 610, 620 via bearings B1, B2, respectively, but in other implementations, the pedestals are coupled to the pedestal tracks by rollers or any other coupling that allows the pedestals to move between the first end and the second end of each respective pedestal track.

The first left pedestal spring 612 is coupled to a first end of the left pedestal 615, and the second left pedestal spring 614 is coupled to a second end of the left pedestal 615. The ends of the springs 612, 614 not coupled to the left pedestal 615 are coupled to a kicking platform 602. The first right pedestal spring 622 is coupled to a first end of the right pedestal 625, and a second right pedestal spring 624 is coupled to a second end of the right pedestal 625. The ends of the springs 622, 624 not coupled to the right pedestal 625 are coupled to a kicking platform 602. The left pedestal springs 612, 614 and the right pedestal springs 622, 624 each create a reaction force in response to movement of the left pedestal 615 and the right pedestal 625 in a either direction along the respective pedestal track 610, 620. In the implementation shown, the springs 612, 614, 622, 624 urge the respective pedestal 615, 625 into a position that is centered on the respective track 610, 620.

The left pedestal springs 612, 614 and the right pedestal springs 622, 624 are each an elastic band in the implementation shown in FIGS. 5A and 5B. However, in other implementations, the pedestal springs may be coil springs, compression springs, or other type of suitable spring to create a reaction force in response to movement of the pedestal along the respective pedestal track.

In the implementation shown in FIG. 5B, the kicking mechanism 600 includes two left pedestal springs and two right pedestal springs, but in other implementations a single pedestal spring is coupled to both of the pedestals. And, in other implementations, one or more pedestal springs are coupled to each of the pedestals, or one or more pedestal springs are coupled to both pedestals. In the implementation shown in FIG. 5B, the pedestal springs provide resistance in either direction, but in other implementations, the pedestal springs provide resistance in at least a first direction or a second direction.

In the implementation shown in FIGS. 5A and 5B, the pedestals 615, 625 are formed from wood. But, in other implementations, the pedestals may include other rigid materials, such as metal or plastic.

In the implementation shown in FIGS. 5A and 5B, the pedestal tracks 610, 620 and pedestal springs 612, 614, 622, 624 are directly coupled to a kicking platform 602 that is coupled (e.g., removably or permanently) to the rotatable platform (e.g., rotatable platform 270). For example, the kicking platform 602 and/or the rotatable platform may have one or more protrusions (e.g., pegs) extending in a direction toward the other of the rotatable platform or the kicking platform, and the other of the rotatable platform or the kicking platform has one or more openings that align with and receive the protrusions to couple the kicking platform 602 to the rotatable platform. In other implementations, the kicking platform 602 may be coupled to the rotatable platform by any suitable fastener, such as bolts, screws, nails, adhesive, and/or clip(s). And, in other implementations, the pedestal tracks 610, 620 may be coupled directly to the rotatable platform.

Figure 6A:
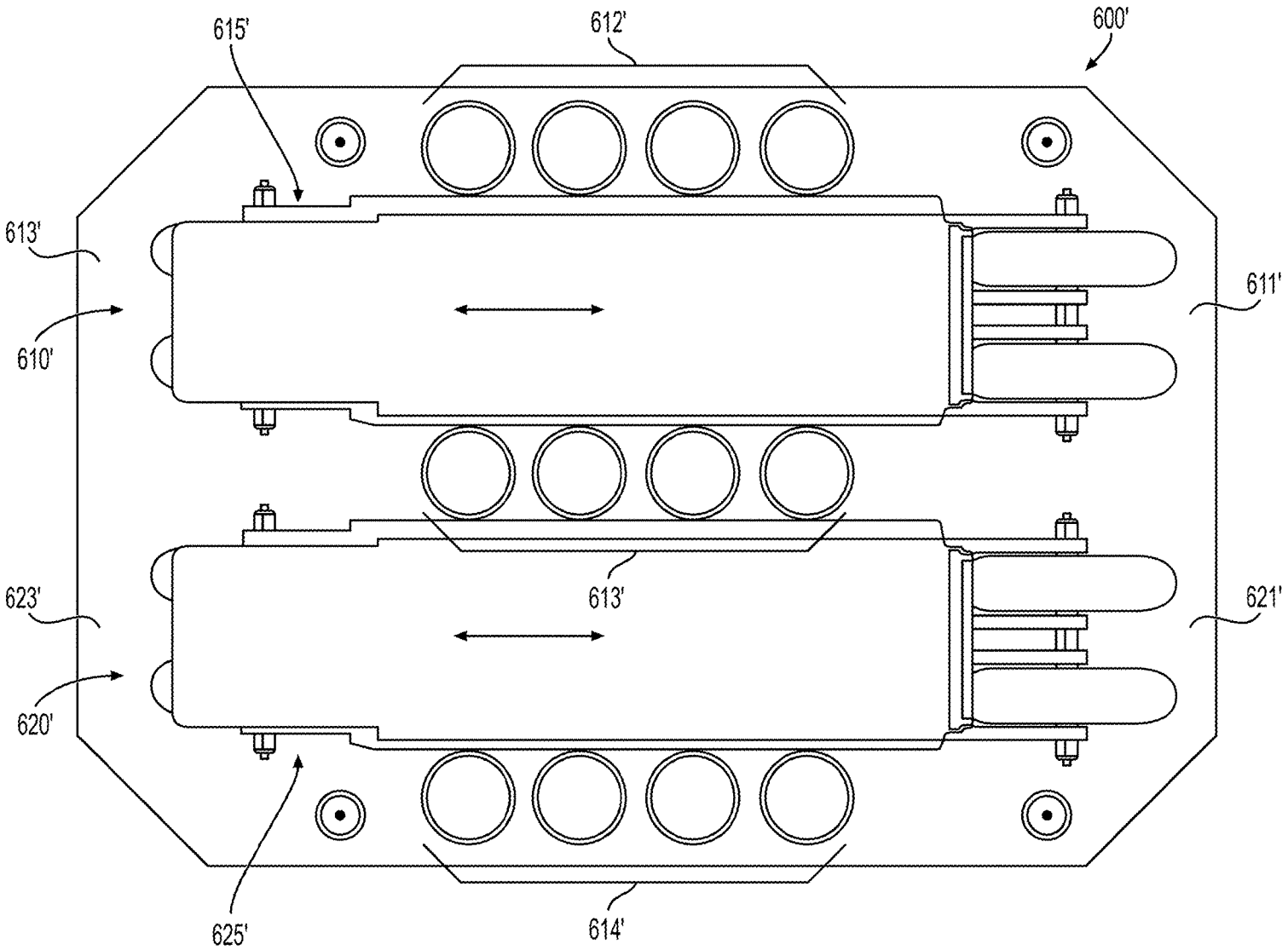
FIG. 6A is a top view of a kicking mechanism for use with the exercise system in FIG. 1, according to some implementations.
Figure 6B:
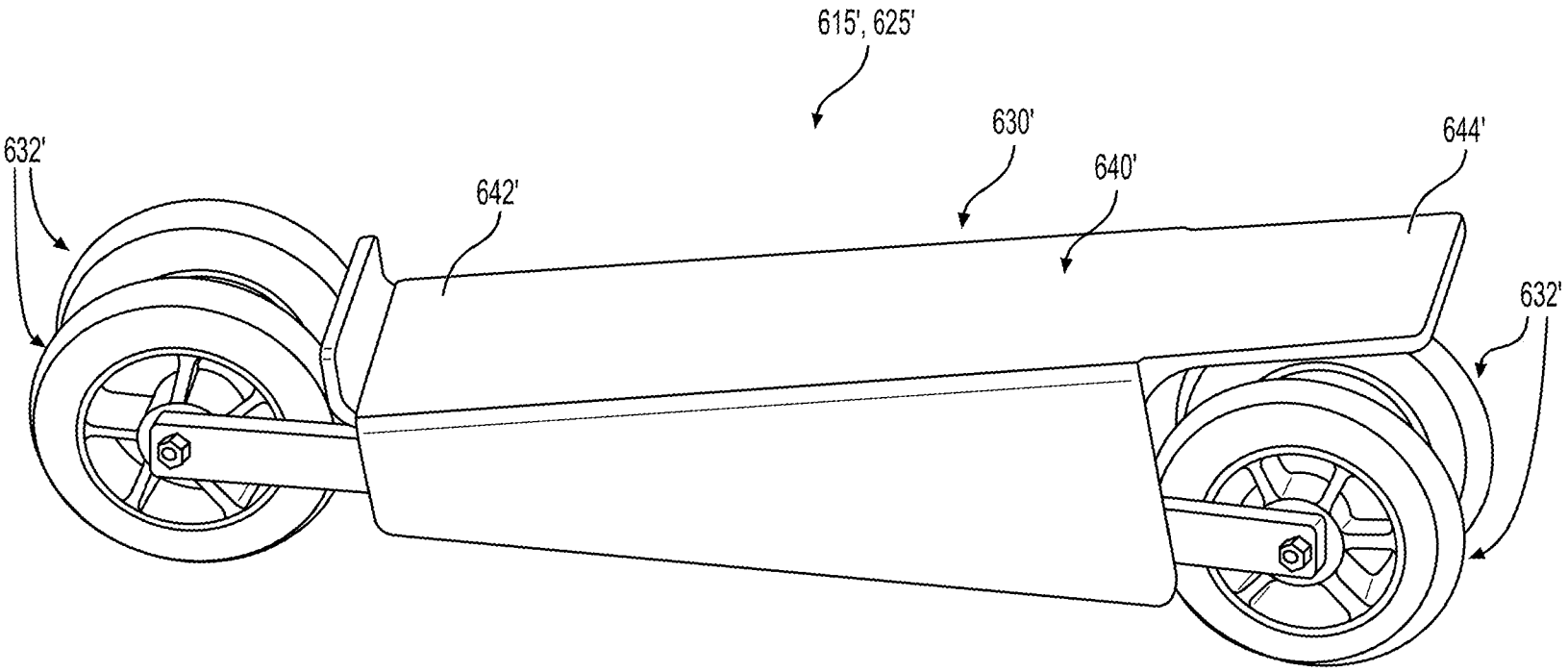
FIG. 6B is a perspective side view of a skate for use with the kicking mechanism shown in FIG. 6A, according to some implementations.
Figure 6C:
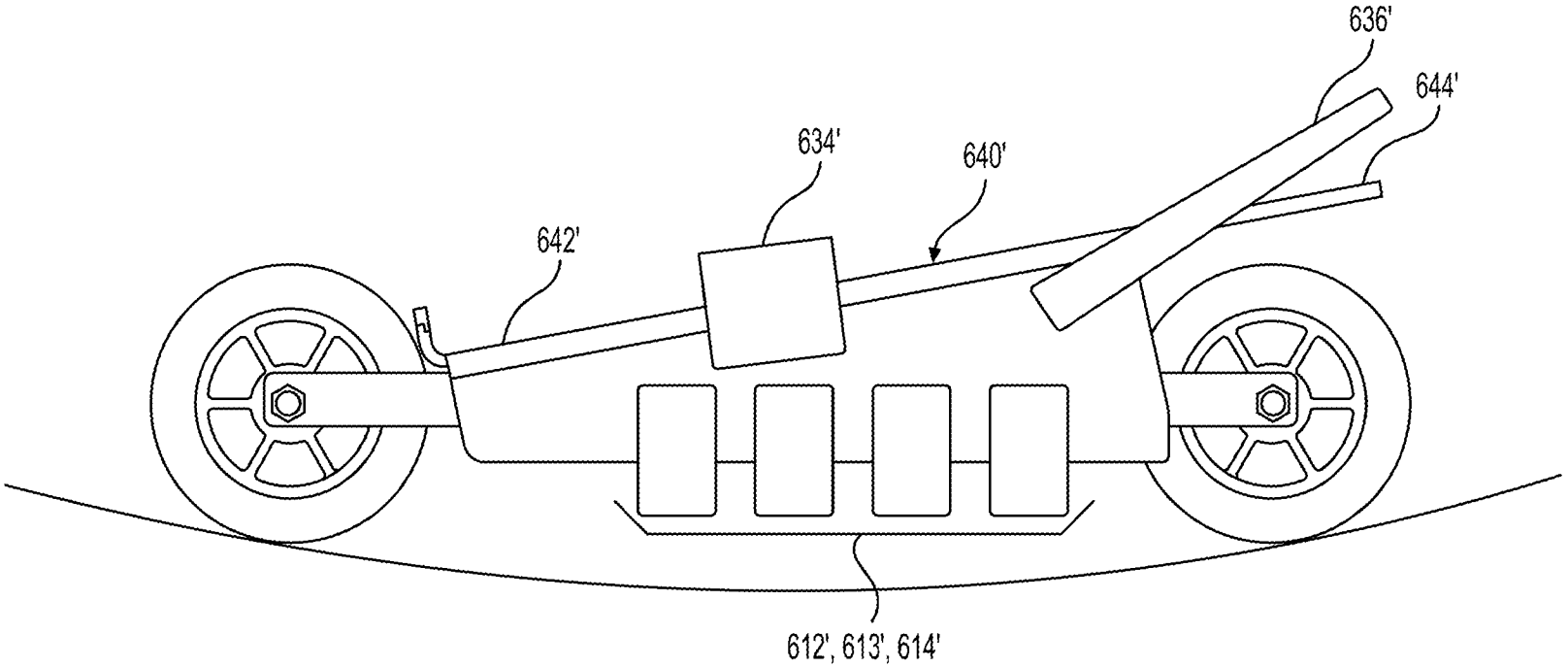
FIG. 6C is a side view of the skate shown in FIG. 6B.

FIGS. 6A-6C show another implementation of a kicking mechanism 600'. Like the kicking mechanism 600 shown in FIGS. 5A and 5B, the kicking mechanism 600' shown in FIGS. 6A-6C can be coupled to the rotatable platform (e.g., rotatable platform 270) to allow a user to move his or her feet individually to simulate a kicking motion of a swimmer. The kicking mechanism 600' includes a left skate track 610', a right skate track 620', a left skate 615', a right skate 625', a first set of rollers 612', a second set of rollers 613', and a third set of rollers 614'.

Each skate 615', 625' shown in FIGS. 6A-6C includes a body 630' having a surface area 640' to support a foot of an average user, four skate wheels 632', a foot strap 634', and a heel strap 636'. The surface area 640' includes a toe portion 642' configured to support the toes of a user and a heel portion 644' configured to support the heel of a user. Two skate wheels 632' are rotatably coupled to each end adjacent the toe portion 642' and the heel portion 644' of the body 630' of each skate 615', 625'. The skate wheels 632' are coupled to the body 630' such that the body 630' can roll on the skate wheels 632' in a longitudinal direction of the body 630' from the toe portion 642' to the heel portion 644'. The skate wheels 632' are coupled to the body 630' such that the surface area 640' of the body 630' is disposed at an incline, from the toe portion 642' to the heel portion 644', relative to a plane defined by each of the rotational axes of the skate wheels 632' of their respective skate 615', 625'. Each skate 615', 625' also includes a foot strap 634' configured to extend over a user's foot to secure the sole of the foot to the surface area 640' of the body 630' and a heel strap 636' configured to extend around a rear portion of a user's heel and/or ankle to secure the user's foot toward the toe portion 642' and into the foot strap 634'. The user places his or her left foot onto the surface area 640' of the left skate 615' and his or her right foot onto the surface area 640' of the right skate 625'. The user then secures his or her feet to the surface area 640' of each skate 615', 625' using the foot strap 642' and the heel strap 644' of each respective skate 615', 625'.

Each skate track 610', 620' includes a first end 611', 621' and a second end 613', 623'. The left skate track 610' and the right skate track 620' extend parallel to each other and are disposable on the surface of the rotatable platform (e.g., rotatable platform 270) that faces away from the support surface 12.

The first set of rollers 612' is disposed along a lateral side of the first skate track 610', the third set of rollers 614' is disposed along a lateral side of the second skate track 620', and the second set of rollers 613' is disposed between the first skate track 610' and the second skate track 620'. Each of the first set of rollers 612', the second set of rollers 613', and the third set of rollers 614' include four rollers that are rotatable about axes that are perpendicular to the rotatable platform 270.

The left skate 615' is slidably disposed on the left skate track 610', and the right skate 625' is slidably disposed on the right skate track 620'. The skate wheels 632' are configured to allow the skate 615', 625' to move longitudinally along an axis that extends between the first end 611', 621' and the second end 613', 623' of each respective skate track 610', 620' such that the first set of rollers 612', the second set of rollers 613', and the third set of rollers 614' guide the sides of the skates as they move along the skate tracks to retain the skates on the skate tracks.

Although the first set of rollers 612', a second set of rollers 613', and a third set of rollers 614' of the kicking mechanism 600' shown in FIGS. 6A-6C each include four adjacent rollers, in some implementations, the kicking device includes any number of sets of rollers, and each set of rollers includes any number of rollers configured in any way.

The left skate track 610' and the right skate track 620' shown in FIGS. 6A-6C extend along arcuate paths as viewed in a plane that includes the axis of the track. The arcuate path includes a lowest point, relative to a vertical axis, between the respective first ends 611', 621' and second ends 613', 623' of the axis of the track. The arcuate path allows the skates 615', 625' to move from one end toward the center of the left skate track 610' and the right skate track 620' with relative ease but then create a gravitational resistance to continuing to move toward the opposite end of the left skate track 610' and the right skate track 620'. Although the left skate track 610' and the right skate track 620' of the kicking mechanism 600' shown in FIGS. 6A-6C extend along an arcuate path, in some implementations, the left skate track and the right skate track extend along a V-shaped path or any other shape path that includes a low point between the first end and the second end and inclines extending from the low point toward each of the first end and second end.

The kicking mechanism 600' shown in FIGS. 6A-6C is a stand-alone device in that a user may work on the kicking device alone without its attachment to the rotating table. The kicking mechanism 600' is set up to break down each aspect of swimming into individual parts to create module training rather than the entire coordination of all the aspects of swimming at once. The essence of kicking in swimming is kicking "from the hip" with very slight flexing of the knees. The kicking mechanism 600' shown in FIGS. 6A-6C is operated in this way. The muscle development that is taking place is rapidly reversing this large muscle group from moving toward the first end to moving toward the second end. The slight amplitude of the arcuate path of the skate tracks of the kicking mechanism 600' is designed to train the swimmer's muscle memory on how to reverse that large muscle group rapidly with a fluid movement of the legs. The amplitude of the first end and the second end of the skate tracks of the kicking mechanism 600' shown in FIGS. 6A-6C is 4 inches. The arcuate path of the skate tracks provides the user muscle memory for a quick minimalist kick required for sprinting or general workout. However, in some implementations, the amplitude of the first end, the second end, or both of the skate tracks is flat (0 inches of amplitude) or any number of inches. The skate tracks on which the skates travel can be elongated for distance swimmers and less active users.

FIG. 7 shows an implementation of the exercise system, such as system 10 described above, that includes a mirror 700. The mirror 700 allows a user to observe their own exercise form during use of the system 10. The mirror 700 is disposed between the left vertical member 316 and the right vertical member 318, such that the mirror 700 is visible to a user operating the exercise system 10. In some implementations, the mirror 700 is adjustably mounted to the exercise system 10 such that the mirror could be tilted to optimize visibility for users of different heights. For example, the mirror 700 can be coupled to the exercise system 10 by hinges, pivots, tracks or any other support mechanism suitable to dispose the mirror in a viewable position by a user of the exercise system 10.

A number of implementations have been described. The description in the present disclosure has been presented for purposes of illustration but is not intended to be exhaustive or limited to the implementations disclosed. It will be understood that various modifications and variations will be apparent to those of ordinary skill in the art and may be made without departing from the spirit and scope of the claims. Accordingly, other implementations are within the scope of the following claims. The implementations described were chosen in order to best explain the principles of the claims, and to enable others of ordinary skill in the art to understand the various implementations with various modifications as are suited to the particular use contemplated.

The terminology used herein is for the purpose of describing particular implementations only and is not intended to be limiting of the disclosure. As used herein, the singular forms "a," "an," and "the" are intended to include the plural forms as well, unless the context clearly indicates otherwise. It will be further understood that the terms "comprises" and/or "comprising." when used in this specification, specify the presence of stated features, operations, elements, and/or components, but do not preclude the presence or addition of one or more other features, operations, elements, components, and/or groups thereof.

The invention claimed is:

1. An exercise system comprising:

an arm movement system comprising:

a first handle guide comprising a central axis that extends between a first end and a second end of the first handle guide, wherein the first and second ends of the first handle guide are respectively fixed to an upper horizontal member and a lower horizontal member of a non-pivotable frame of the exercise system;

a second handle guide, adjacent to the first handle guide, the second handle guide comprising a central axis that extends between a first end and a second end of the second handle guide, wherein the first and second ends of the second handle guide are respectively fixed to the upper and lower horizontal members of the non-pivotable frame, and wherein the central axes of the first handle guide and the second handle guide are parallel in a resting position;

a first handle movably coupled to the first handle guide between the first and second ends of the first handle guide; and a second handle movably coupled to the second handle guide between the first and second ends of the second handle guide; and a torso movement system comprising:

a rotatable platform having a rotational axis, wherein the rotatable platform is rotatable about the rotational axis thereof, wherein the first and second handle guides are mechanically decoupled from and spaced apart from the rotatable platform, wherein the central axis of each handle guide is parallel to the rotational axis of the rotatable platform, and the rotatable platform is disposed adjacent to the handle guides such that a user having the user's body supported by the rotatable platform can reach the handles with the user's hands.

2. The exercise system of claim 1, wherein:

each handle guide comprises first and second handle guide cords and first and second handle guide springs, wherein the first handle guide spring is coupled to one end of the first handle guide cord, and the second handle guide spring is coupled to one end of the second handle guide cord, and the handle guide springs create a reaction force in response to movement of the respective handle along the handle guide cords in a direction that has a perpendicular component relative to the central axis of the respective handle guide.

3. The exercise system of claim 2, wherein each handle guide further comprises third and fourth handle guide springs, wherein the third handle guide spring is coupled to another end of the first handle guide cord, and the fourth handle guide spring is coupled to another end of the second handle guide cord.

4. The exercise system of claim 3, wherein each of the handle guide springs comprises an elastic band.

5. The exercise system of claim 1, further comprising a first handle spring coupled to the first handle and a second handle spring coupled to the second handle, wherein the first handle spring creates a reaction force in response to movement of the first handle in a direction that has a parallel component relative to the central axis of the first handle guide and the second handle spring creates a reaction force in response to movement of the second handle in a direction that has a parallel component relative to the central axis of the second handle guide.

6. The exercise system of claim 5, further comprising a first handle weight coupled to the first handle and a second handle weight coupled to the second handle.

7. The exercise system of claim 6, further comprising first and second handle damping springs, wherein the first handle damping spring is coupled to and disposed between the first handle weight and the first handle, and the second handle damping spring is coupled to and disposed between the second handle weight and the second handle.

8. The exercise system of claim 7, wherein each of the handle damping springs comprises an elastic band.

9. The exercise system of claim 1, wherein the central axes of the handle guides are disposed in a plane that is at an angle from 80° to 100° relative to a support surface on which the exercise system is configured to be disposed.

10. The exercise system of claim 1, wherein the first handle guide and the second handle guide are axially bendable.

11. The exercise system of claim 1, further comprising a torso weight coupled to the rotatable platform, wherein the torso weight coupled to the rotatable platform provides a resistive force against rotational movement of the rotatable platform about the rotational axis from a start position to an angular position spaced apart from the start position.

12. The exercise system of claim 11, wherein the torso weight is coupled to the rotatable platform by a linkage that extends between the torso weight and the rotatable platform.

13. The exercise system of claim 12, wherein the linkage comprises an axially bendable cord.

14. The exercise system of claim 13, wherein the axially bendable cord comprises first and second axially bendable cords, a first end of the first axially bendable cord is coupled to a first portion of the rotatable platform, a first end of the second axially bendable cord is coupled to a second portion of the rotatable platform, and second ends of the axially bendable cords are coupled to the torso weight, wherein the first portion and the second portion of the rotatable platform are separated by a plane that includes the rotational axis.

15. The exercise system of claim 13, further comprising a ring bearing coupling a first surface of the rotatable platform to a stationary platform, wherein the first surface faces the stationary platform, and a second surface of the rotatable platform is opposite the first surface and faces away from the stationary platform.

16. The exercise system of claim 11, further comprising a torso damping spring coupled to and disposed between the torso weight and the rotatable platform.

17. The exercise system of claim 11, further comprising a track having an arcuate shaped portion, wherein the torso weight is movably coupled to the arcuate shaped portion of the track, wherein the track has a first end and a second end, and the arcuate shaped portion is disposed between the first and second ends, wherein a center of the arcuate shaped portion is disposed in a plane that is closer than the ends of the track to a support surface on which the system is configured for being disposed.

18. The exercise system of claim 1, wherein the rotational axis of the rotatable platform extends perpendicular to a support surface on which the system is configured for being disposed.

19. The exercise system of claim 1, further comprising a chair coupled to the rotatable platform.

20. The exercise system of claim 1, further comprising a kicking mechanism coupled to the rotatable platform, the kicking mechanism comprising:

a first pedestal guide and a second pedestal guide, each pedestal guide comprising a track having a first end and a second end;

a first pedestal movably coupled to the first pedestal guide and a second pedestal movably coupled to the second pedestal guide;

a first pedestal spring coupled to the first pedestal that creates a reaction force in response to movement of the first pedestal in a first direction along the respective track; and a second pedestal spring coupled to the second pedestal that creates a reaction force in response to movement of the second pedestal in the first direction along the respective track.

21. The exercise system of claim 20, wherein the kicking mechanism further comprises a third pedestal spring coupled to the first pedestal that creates a reaction force in response to movement of the first pedestal in a second direction along the respective track, and a fourth pedestal spring coupled to the second pedestal that creates a reaction force in response to movement of the second pedestal in the second direction along the respective track, wherein the first direction is opposite the second direction.

22. The exercise system of claim 1, further comprising a kicking mechanism coupled to the rotatable platform, the kicking mechanism comprising:

a first skate guide and a second skate guide, each skate guide comprising a skate track having a first end and a second end; and a first skate movably coupled to the first skate guide and a second skate movably coupled to the second skate guide, wherein each of the first and second skates includes a body and one or more skate wheels rotatably coupled to the body, wherein the first skate guide extends along a first arcuate path having a lowest point between the first end and second end of the first skate guide, and wherein the second skate guide extends along a second arcuate path having a lowest point between the first end and second end of the second skate guide.

* * * * *